US006336404B1

(12) United States Patent
Sakamoto

(10) Patent No.: US 6,336,404 B1
(45) **Date of Patent: *Jan. 8, 2002**

(54) PRINTING APPARATUS, AND A PROCESSING DEVICE IN THE PRINTING APPARATUS

(75) Inventor: Tatsuya Sakamoto, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/481,701

(22) Filed: Jan. 12, 2000

(30) Foreign Application Priority Data

Feb. 1, 1999 (JP) ..... 11-024235
Sep. 9, 1999 (JP) ..... 11-255724

(51) Int. Cl.[7] ..... B41M 5/00; B41N 3/00; B41F 16/00; B41F 9/00

(52) U.S. Cl. ..... 101/463.1; 101/465; 101/472; 101/142

(58) Field of Search ..... 101/135–145, 101/216, 401.1, 463.1, 477, 465–467, 472; 430/302, 309, 310; 355/27, 85, 106

(56) References Cited

U.S. PATENT DOCUMENTS 4,729,310 A * 3/1988 Love, III ..... 101/157
5,438,384 A 8/1995 Earle
5,469,787 A 11/1995 Turner et al.
5,842,414 A 12/1998 Yoshida et al.
6,138,566 A * 10/2000 Sakamoto ..... 101/463.1

FOREIGN PATENT DOCUMENTS

EP 0 512 549 B1 11/1992
JP 11105235 A 4/1999

* cited by examiner

*Primary Examiner*—Kimberly L. Asher
(74) *Attorney, Agent, or Firm*—Arent Fox Kintner Plotkin & Kahn, PLLC

(57) ABSTRACT

A processing device in a printing apparatus includes a developer feed roller partly immersed in a developer stored in a developer tank, a fixer feed roller partly immersed in a fixer stored in a fixer tank, and a drive mechanism for rotating the developer feed roller and fixer feed roller. Each of the developer feed roller and fixer feed roller has positioning members mounted on opposite end portions thereof to position the surface of the roller at a slight distance from an image area of a printing plate. Thus, the developer feed roller feeds the developer to the image area without contacting the image area, while the fixer feed roller feeds the fixer to the image area without contacting the image area.

10 Claims, 25 Drawing Sheets

111
112
113
121
66
65
122
74
73
64
61
133
136
123
68
67
71
72
63
62
116
118
117
115
133
136
139
156
137

PRINTING APPARATUS, AND A PROCESSING DEVICE IN THE PRINTING APPARATUS

BACKGROUND OF THE INVENTION

1. Field of the Invention

The present invention relates to a printing apparatus for recording images on printing plates mounted peripherally of plate cylinders, feeding processing solutions from processing solution feed rollers to the plates to develop image areas of the plates having the images recorded thereon, and thereafter printing the images by feeding ink to the plates. The invention relates also to a processing device for use in the printing apparatus.

2. Description of the Related Art

In an ordinary conventional printing apparatus, a prepress process is carried out first to make a plate by exposing the plate placed in contact with a film having a binarized black and white image recorded thereon. Then, the plate is loaded into the printing apparatus to carry out a printing process.

Recently, printing apparatus commonly called digital printers have been proposed, one such printer being capable of performing both the prepress process and printing process. The digital printers employ a "computer-to-plate" system for forming images on plates by directly scanning and exposing the plates with laser beams or the like modulated with image signals.

A processing device for use in such a printing apparatus is described, for example, in Japanese Patent Publication (Unexamined) H11-105235 (1999). This processing device places a developer feed roller in contact with a printing plate to feed a developer to an image area thereof, and then places a fixer feed roller in contact with the plate to feed a fixer to the image area, thereby developing and fixing the image area having an image recorded thereon.

In the processing device described in the above publication, processing solutions such as the developer and fixer are fed to the image area of the printing plate from the developer feed roller and fixer feed roller placed in contact with the image area. Thus, the image area is rubbed by the developer feed roller and fixer feed roller. This could result in a processing unevenness due to vibration of the developer feed roller and fixer feed roller.

In the developing process for processing the image area of the plate with the developer, silver is continually deposited around cores provided by silver deposits formed from the developer initially contacting the image area. In the construction where the developer feed roller is placed in contact with the image area to feed the developer to the image area, the silver deposits formed immediately after the developer is fed are rubbed by the developer feed roller. This could result in an imperfect deposition of silver. In such a case, the plate has reduced durability after the developing process.

Further, it is desirable that, in such a printing apparatus, the processing device is easily movable to a position for maintenance services.

SUMMARY OF THE INVENTION

An object of the present invention, therefore, is to provide a processing device in a printing apparatus which is free from a processing unevenness due to vibration of a developer feed roller and a fixer feed roller, and which can prevent reduced durability due to an insufficient deposition of silver.

The above object is fulfilled, according to the present invention, by a processing device in a printing apparatus for recording an image on a plate mounted peripherally of a plate cylinder, developing an image area of the plate with the image recorded thereon by feeding a processing solution from a processing solution feed roller to the plate, and printing the image by feeding ink to the plate, wherein the processing device comprises a processing solution tank for storing the processing solution for processing the plate; the processing solution feed roller having a portion thereof immersed in the processing solution stored in the processing solution tank; a drive mechanism for rotating the processing solution feed roller; and a positioning mechanism for positioning the processing solution feed roller such that a surface of the processing solution feed roller is slightly spaced from a surface of the plate; whereby the processing solution feed roller feeds the processing solution to the image area without contacting the image area.

With the above processing device, the processing solution may be applied to the image area of the plate in a noncontact mode. This construction effectively avoids a processing unevenness due to vibration of a developer feed roller or fixer feed roller, and reduced durability due to an insufficient deposition of silver.

In one preferred embodiment, the positioning mechanism includes positioning members having a larger outside diameter than the processing solution feed roller, and mounted coaxially on opposite end portions of the processing solution feed roller.

Preferably, the positioning members are arranged to contact the plate between side edges of the plate and side edges of the image area.

The positioning members may be arranged to contact the plate cylinder in regions thereof outwardly of opposite sides of the plate.

In another preferred embodiment, the drive mechanism is operable to rotate the processing solution feed roller with the surface thereof slightly spaced from the surface of the plate to form an accumulation of the processing solution between the surface of the plate and the surface of the processing solution feed roller before applying the processing solution to and processing the image area of the plate.

Preferably, the drive mechanism is operable to rotate the processing solution feed roller with the surface thereof slightly spaced from the surface of the plate, in a position opposed to a region between a forward end of the plate and a forward end of the image area.

In another aspect of the invention, a printing apparatus is provided, which comprises a plate cylinder for supporting a plate mounted peripherally thereof; an image recorder for recording an image on the plate mounted peripherally of the plate cylinder; a processing device for feeding a processing solution to and processing an image area of the plate where the image is recorded, the processing device including a processing solution feed roller slightly spaced from the image area to feed the processing solution to the image area in a substantially non-contact mode, and a drive mechanism for rotating the processing solution feed roller; an ink feed mechanism for feeding ink to the plate; and a transfer mechanism for transferring the ink from the plate to printing paper.

In a further aspect of the invention, a printing apparatus comprises a plate cylinder for supporting a plate mounted peripherally thereof; an image recorder for recording an image on the plate mounted peripherally of the plate cylinder; a processing device for feeding a processing solution to and processing an image area of the plate where the image is recorded, the processing device including a processing solution feed roller for feeding the processing solution to the image area, and a roller moving mechanism for moving the processing solution feed roller between a processing position adjacent the plate mounted peripherally of the plate cylinder and a retracted position away from the plate; a moving mechanism for moving the processing device in a substantially horizontal direction perpendicular to an axis of the plate cylinder; an ink feed mechanism for feeding ink to the plate; an impression cylinder rotatable with printing paper mounted peripherally thereof; a blanket cylinder for transferring the ink from the plate to the printing paper mounted peripherally of the impression cylinder; a printing paper feed mechanism for feeding the printing paper to the impression cylinder; and a printing paper discharge mechanism for discharging the printing paper having been printed from the impression cylinder.

With these printing apparatus, the processing device may easily be moved to a position for maintenance services.

Other features and advantages of the present invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
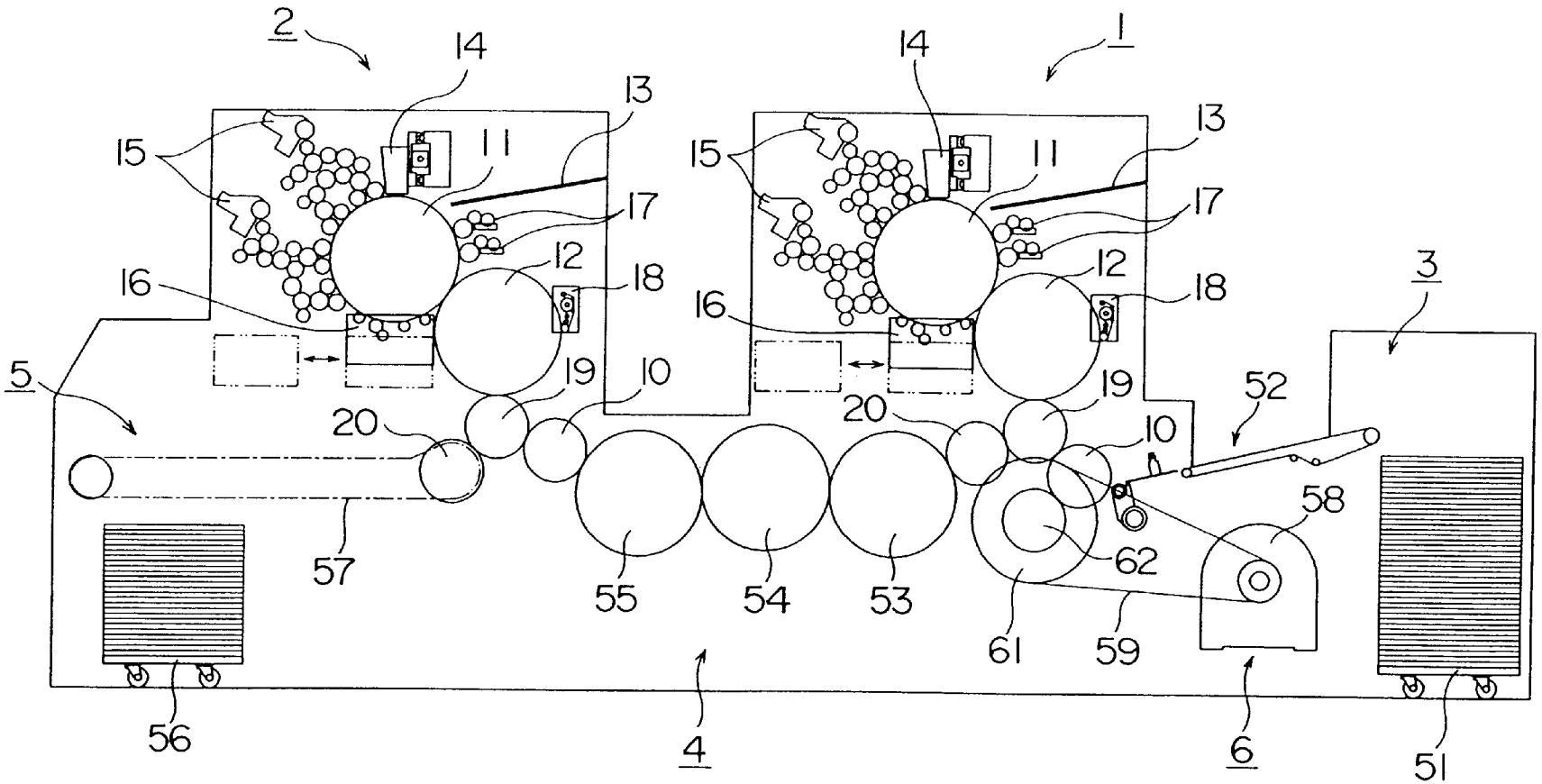
FIG. 1 is a schematic side view of a printing apparatus according to the present invention.

Embodiments of the present invention will be described hereinafter with reference to the drawings. FIG. 1 is a schematic side view of a printing apparatus according to the present invention.

This printing apparatus makes plates by recording and developing images on blank plates mounted on plate cylinders 11, feeds inks to the plates having the images recorded thereon, and transfers the inks from the plates through blanket cylinders 12 to printing paper held on impression cylinders 19, thereby printing the images on the printing paper.

The printing apparatus includes a first printing unit 1 and a second printing unit 2 each for printing with two color inks, a paper feeder 3 for feeding printing paper to the first printing unit 1, an intermediate transport section 4 for transporting the printing paper from the first printing unit 1 to the second printing unit 2, a paper discharger 5 for discharging the printing paper from the second printing unit 2, and a printing driver 6 for synchronously rotating the plate cylinders 11, blanket cylinders 12, impression cylinders 19 and intermediate transport section 4.

The construction of the first printing unit 1 and second printing unit 2 will be described first.

The first printing unit 1 includes the plate cylinder 11 constructed to hold two plates mounted peripherally thereof, the blanket cylinder 12 equal in diameter to the plate cylinder 11, the impression cylinder 19 having half the diameter of the plate cylinder 11 and blanket cylinder 12, a plate feed and remove mechanism 13 for feeding and removing plates to/from the plate cylinder 11, an image recorder 14 for recording images on the two plates mounted peripherally of plate cylinder 11, a processing device 16 for developing and fixing the plates with the images recorded thereon, two dampening water feed mechanisms 17 for feeding dampening water to the two respective plates after the developing process, two ink feed mechanisms 15 for feeding inks to the two respective plates after the dampening water is fed thereto, and a blanket cleaning mechanism 18 for cleaning the surface of blanket cylinder 12 after a printing operation is completed.

Figure 2:
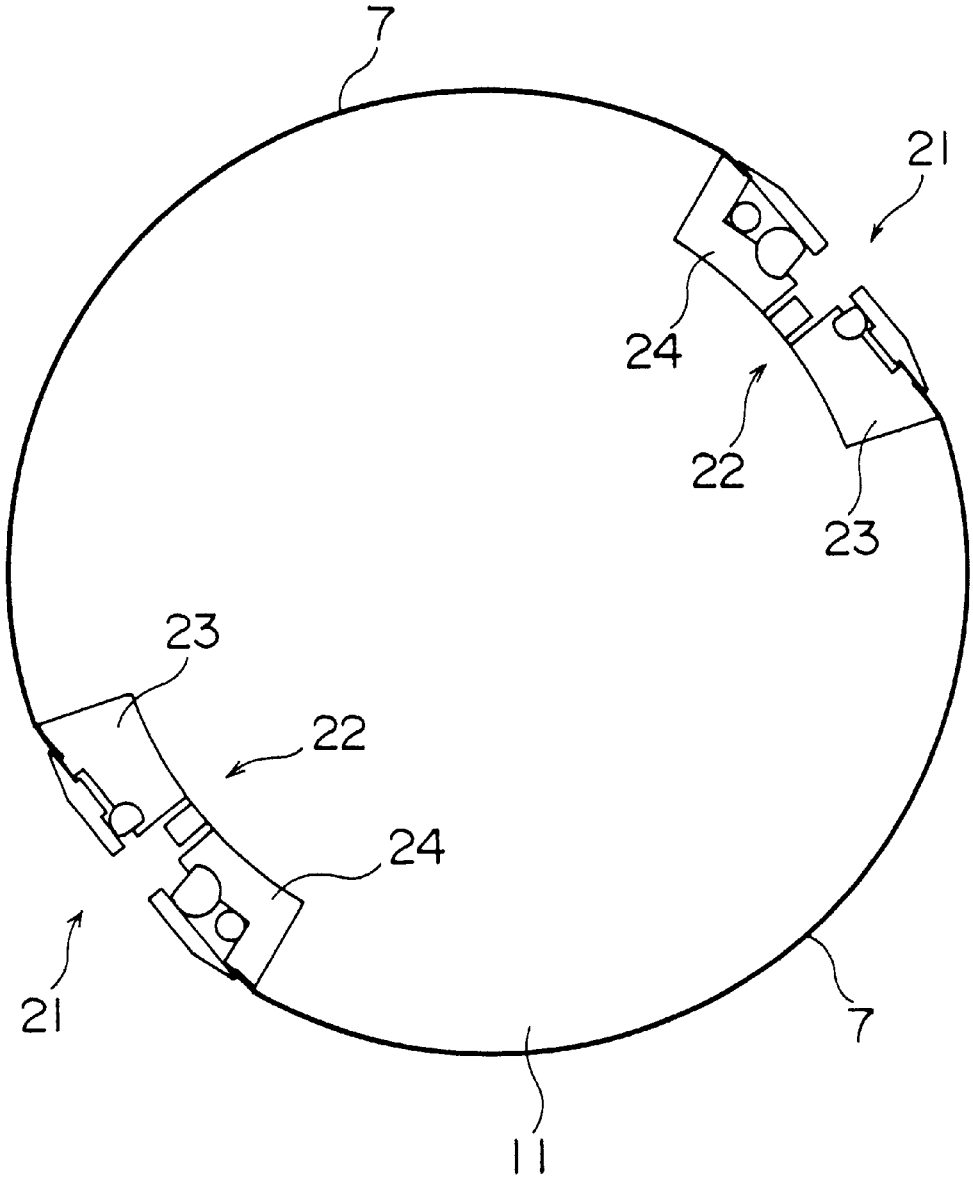
FIG. 2 is a schematic side view of a plate cylinder.

The plate cylinder 11 is used to perform a prepress process of the two plates mounted peripherally thereof and a printing process using these plates. As shown in FIG. 2, the plate cylinder 11 has a pair of cylinder grooves 21. Each groove 21 houses a plate grip mechanism 22 for gripping the forward end of one plate 7 and the rear end of the other plate 7.

Figure 3:
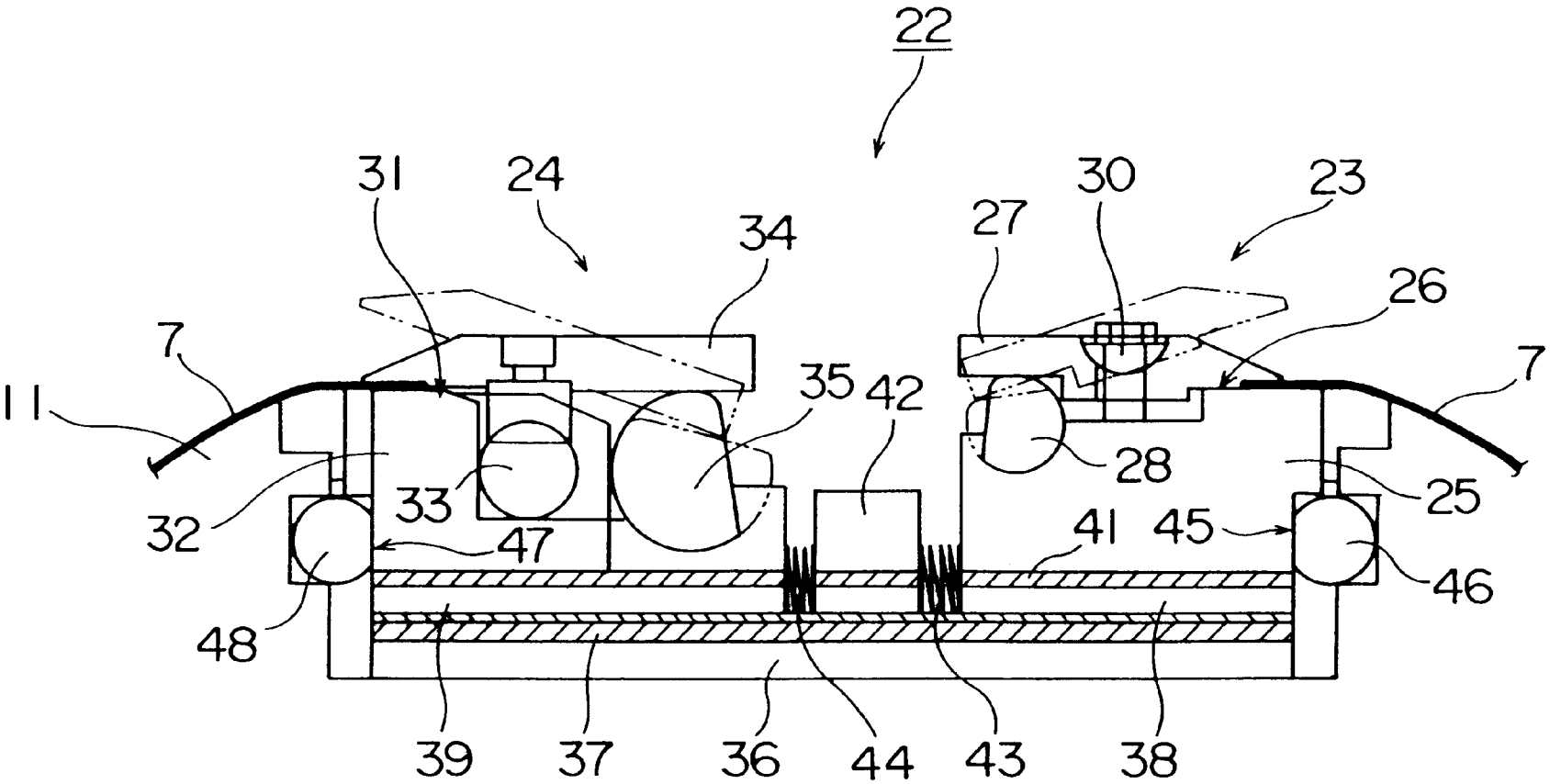
FIG. 3 is a side view of a plate grip mechanism.
Figure 4:
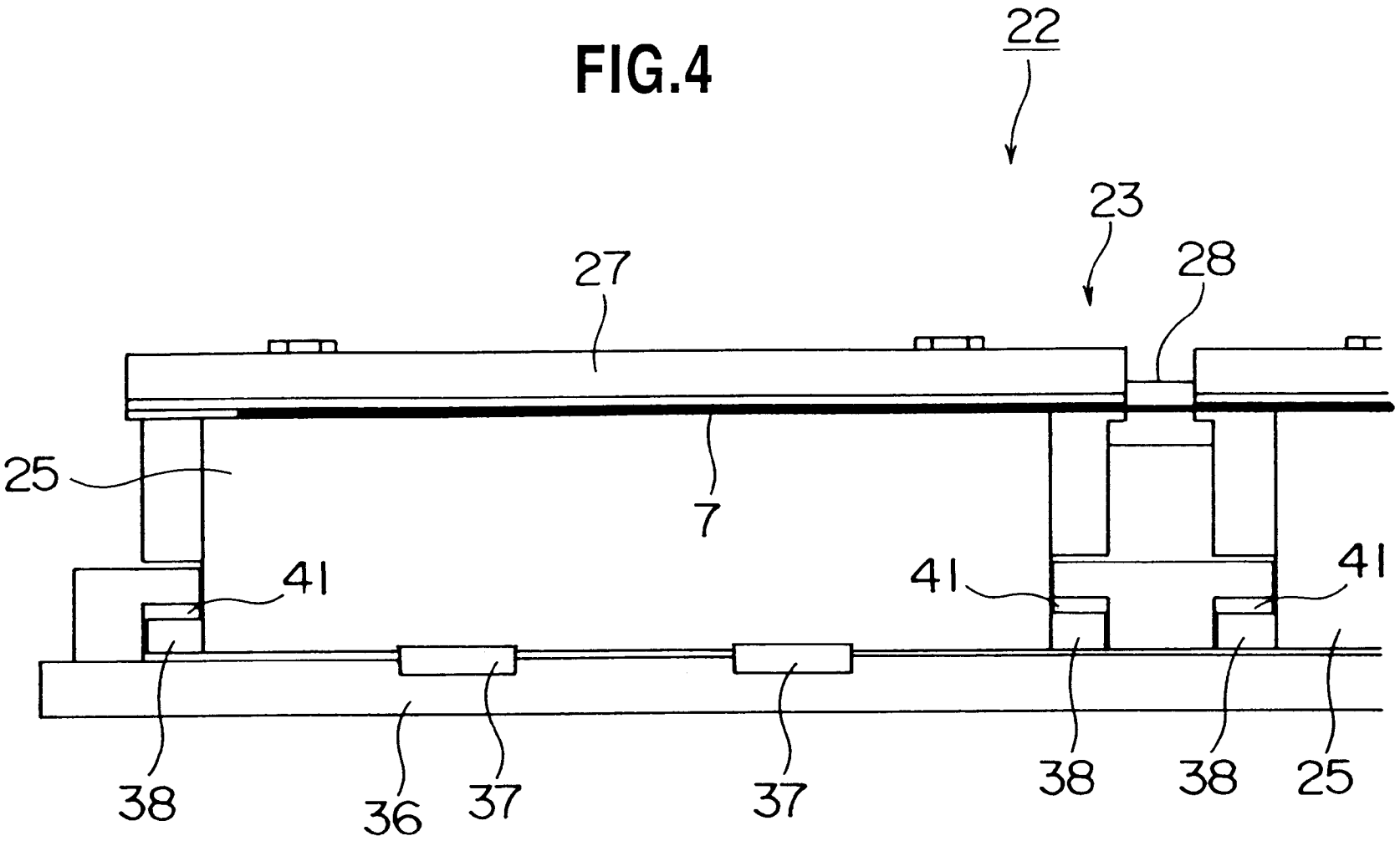
FIG. 4 is a front view of the plate grip mechanism.

FIG. 3 is a side view of the plate grip mechanism 22 disposed in each cylinder groove 21 of plate cylinder 11. FIG. 4 is a front view of the plate grip mechanism 22.

The plate grip mechanism 22 includes a plate gripper 23 for gripping the rear end of one plate 7, and a plate gripper 24 for gripping the forward end of the other plate 7.

The plate gripper 23 for gripping the rear end of one plate 7 has a seat 25 defining an upper receiving surface 26, and pawls 27 pivotable about a support axis 30. Each pawl 27 is pivotable between a pinch position shown in a solid line in FIG. 3 and an open position shown in a two-dot chain line. The pawl 27 is biased to the open position by a spring not shown. Four such pawls 27 are arranged axially of plate cylinder 11.

A cam shaft 28 is disposed between the rear ends of pawls 27 and the seat 25. The cam shaft 28 is operable to move each pawl 27 to the pinch position shown in the solid line in FIG. 3. When the pawl 27 is in the pinch position, the rear end of plate 7 is pinched between a lower surface at the forward end thereof and the receiving surface 26. When the cam shaft 28 is rotated to a position shown in a two-dot chain line in FIG. 3, the rear end of each pawl 27 moves into contact with a cutout formed in the cam shaft 28, whereupon the pawl 27 is moved to the open position by the action of the spring not shown.

On the other hand, the plate gripper 24 for gripping the forward end of the other plate 7 has a seat 32 defining an upper receiving surface 31, and pawls 34 pivotable about a support axis 33. Each pawl 34 is pivotable between a pinch position shown in a solid line in FIG. 3 and an open position shown in a two-dot chain line. The pawl 34 is biased to the open position by a spring not shown. Four such pawls 34 are arranged axially of plate cylinder 11.

A cam shaft 35 is disposed between the rear ends of pawls 34 and the seat 32. The cam shaft 35 is operable to move each pawl 34 to the pinch position shown in the solid line in FIG. 3. When the pawl 34 is in the pinch position, the forward end of plate 7 is pinched between a lower surface at the forward end thereof and the receiving surface 31. When the cam shaft 35 is rotated to a position shown in a two-dot chain line in FIG. 3, the rear end of each pawl 34 moves into contact with a cutout formed in the cam shaft 35, whereupon the pawl 34 is moved to the open position by the action of the spring not shown.

The grip mechanism 22 includes a base 36 with a plurality of rails 37 arranged thereon, the plate grippers 23 and 24 being slidable along the rails 37. The seats 25 and 32 of plate grippers 23 and 24 have projections 38 and 39, respectively. These projections 38 and 39 are pressed at upper surfaces thereof by rails 41. Thus, the grippers 23 and 24 are reciprocable right and left in FIG. 3 (perpendicular to the plane of FIG. 4).

A stationary block 42 is disposed centrally of base 36. A spring 43 is disposed between the stationary block 42 and seat 25, while a spring 44 is disposed between the stationary block 42 and seat 32. A cam shaft 46 with a cutout 45 is disposed between side walls of seat 25 and cylinder groove 21. A cam shaft 48 with a cutout 47 is disposed between side walls of seat 32 and cylinder groove 21.

The cam shafts 46 and 48 may be rotated from the positions shown in FIG. 3, with the plate gripper 23 gripping the rear end of one plate 7, and the plate gripper 24 gripping the forward end of the other plate 7. Then, the plate grippers 23 and 24 move toward each other. Consequently, the plates 7 are extended over the peripheral surface of plate cylinder 11.

Figure 5:
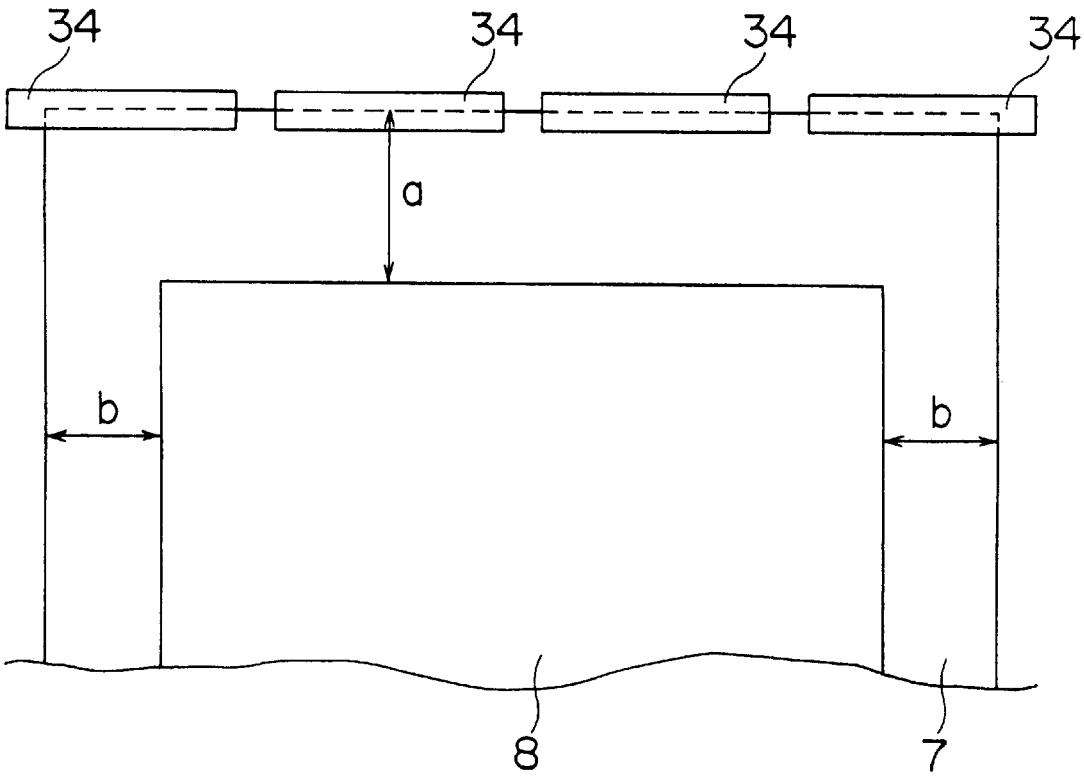
FIG. 5 is an explanatory view schematically showing pawls gripping a forward end of a printing plate.

FIG. 5 is an explanatory view schematically showing the pawls 34 of plate gripper 24 gripping the forward end of plate 7.

In this figure, numeral 8 denotes an image area (region where an image is recorded) formed on the plate 7. The pawls 34 of plate gripper 24 are constructed to pinch the plate 7 by a marginal area (region indicated by arrow a in FIG. 5) between the forward end of plate 7 and the forward end of image area 8. Though not shown in this figure, the pawls 27 of plate gripper 23 are constructed to pinch the plate 7 by a marginal area between the rear end of plate 7 and the rear end of image area 8.

Referring again to FIG. 1, each blanket cylinder 12 has the same diameter as the above plate cylinder 11. The blanket cylinder 12 has a blanket mounted peripherally thereof for transferring ink images on the plates 7. The blanket cylinder 12 is rotatable synchronously with the plate cylinder 11 through engagement between a gear disposed laterally of plate cylinder 11 and a gear disposed laterally of blanket cylinder 12.

The impression cylinder 19 is rotatable with printing paper mounted peripherally thereof, and has half the diameter of plate cylinder 11 and blanket cylinder 12. The impression cylinder 19 has a gripper, not shown, mounted peripherally thereof for gripping the forward end of printing paper. The impression cylinder 19, with every two rotations, receives new printing paper from a paper feed cylinder 10, and with every two rotations, discharges printed paper to a paper discharge cylinder 20.

The plate feed and remove mechanism 13 feeds blank plates 7 to the plate cylinder 11, and removes plates 7 used in printing from the plate cylinder 11. The plate feed and remove mechanism 13 includes a plate feeding cassette not shown, a plate removing cassette not shown, and a plate transport mechanism, not shown, for transferring the plates 7 between the plate feeding cassette/plate removing cassette and plate cylinder 11.

The image recorder 14 records images on the two plates 7 mounted peripherally of plate cylinder 11. The image recorder 14 includes numerous LEDs for emitting light beams to the plates 7 on the plate cylinder 11.

The processing device 16 performs developing and fixing processes of the plates 7 after the images are recorded thereon by the image recorder 14. The processing device 16 will be described in detail hereinafter.

The two dampening water feed mechanisms 17 feed dampening water to the two plates 7 mounted peripherally of plate cylinder 11, respectively. Each dampening water feed mechanism 17 includes a storage tank for storing the dampening water, and dampening water feed rollers for feeding the dampening water stored in the storage tank to one of the plates 7 on the plate cylinder 11.

The two ink feed mechanisms 15 feed different color inks to the two respective plates to which the dampening water has been fed by the dampening water feed mechanisms 17. Each ink feed mechanism 15 includes an ink storage for storing an ink, and numerous ink rollers for feeding the ink stored in the ink storage to one of the plates 7 on the plate cylinder 11.

The blanket cleaning mechanism 18 is operable to clean the inked surface of blanket cylinder 12 after a printing operation is completed. The blanket cleaning mechanism 18 includes a cleaning cloth for contacting the blanket on the surface of blanket cylinder 12 to clean the blanket, a cleaning solution supply nozzle for supplying the cleaning cloth with a cleaning solution.

In the first printing unit 1, the plates 7 fed from the plate feed and remove mechanism 13 and mounted peripherally of plate cylinder 11 undergo an image recording process by the image recorder 14 and developing and fixing process by the processing device 16. The plates 7 emerging from a prepress operation, which includes image recording, developing and fixing processes, are fed with the dampening water from the dampening water feed mechanisms 17 and the inks from the ink feed mechanisms 15. The ink images on the plates 7 are transferred through the blanket cylinder 12 to the printing paper mounted peripherally of impression cylinder 19.

The first printing unit 1 and second printing unit 2 are similar in construction. Thus, like reference numerals are used to identify like parts, and the second printing unit 2 will not particularly be described.

However, in the first printing unit 1, the plate cylinder 11 is used to hold a plate for printing a K (black) image on the printing paper, and a plate for printing a C (cyan) image on the printing paper. In the second printing unit 2, the plate cylinder 11 is used to hold a plate for printing an M (magenta) image on the printing paper, and a plate for printing a Y (yellow) image on the printing paper.

The components of this printing apparatus other than the first printing unit 1 and second printing unit 2 will be described next.

The paper feeder 3 includes a paper feed tray 51 for stacking numerous sheets of printing paper, and a paper feed mechanism 52 for separating each sheet of printing paper from the rest stacked on the paper feed tray 51 and transporting it to the paper feed cylinder 10. One paper separating and transporting operation of the paper feeder 3 is executed for every two rotations of the paper feed cylinder 10.

The intermediate transport section 4 includes transfer cylinders 53, 54 and 55 for transferring the printing paper between the paper discharge cylinder 20 of first printing unit 1 and the paper feed cylinder 10 of second printing unit 2. Each of these transfer cylinders 53, 54 and 55 has twice the diameter of the impression cylinder 19 (i.e. the same diameter as the plate cylinder 11 and blanket cylinder 12). Each of these transfer cylinders 53, 54 and 55 has grippers arranged in angular positions 180 degrees apart from each other for gripping the forward ends of sheets of printing paper, respectively.

The paper discharger 5 is operable to receive printed sheets of printing paper from the paper discharge cylinder 20 of second printing unit 2 and discharge the sheets to a paper discharge tray 56. The paper discharger 5 includes an endless chain 57, and a plurality of grippers, not shown, arranged on the chain 57 to be movable while gripping the forward ends of the sheets of printing paper.

The printing driver 6 includes a motor 58 for synchronously rotating the various cylinders in the printing apparatus. The drive of this motor 58 is transmitted by a belt 59 to a pulley 61, and then to the paper feed cylinder 10 of the first printing unit 1 through a gear 62 fixed coaxially to the pulley 61.

Figure 6:
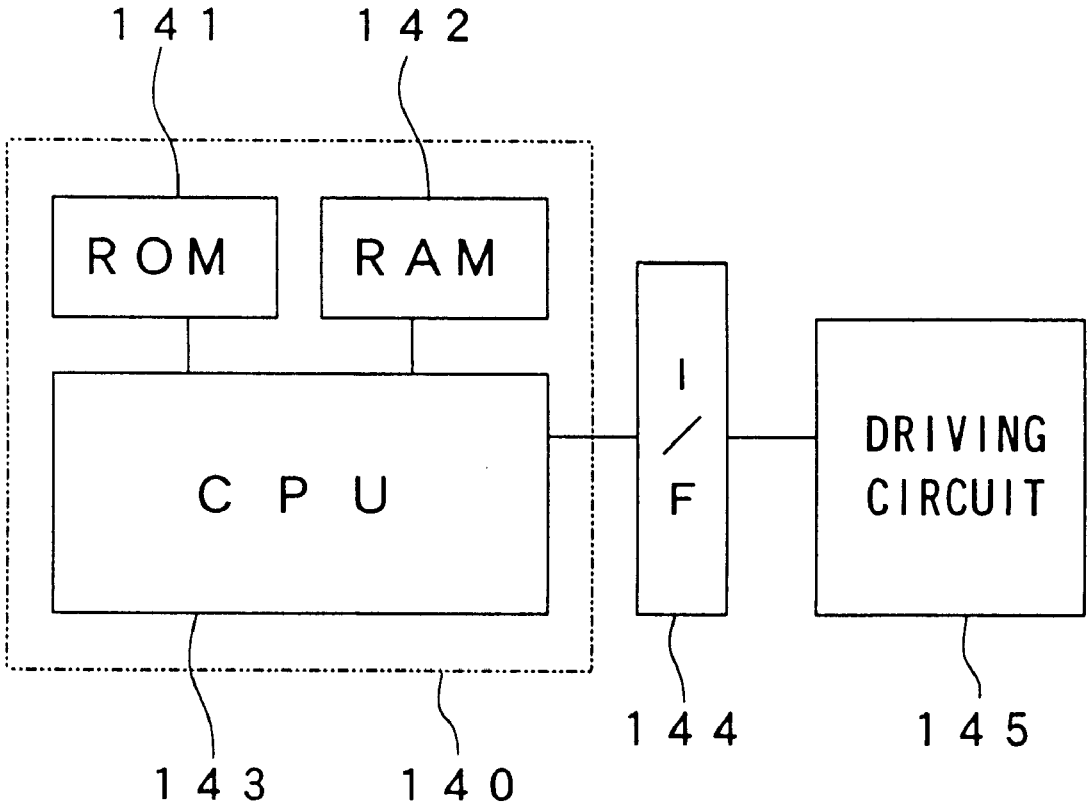
FIG. 6 is a block diagram showing a principal electrical structure of the printing apparatus.

FIG. 6 is a block diagram showing a principal electrical structure of the printing apparatus.

This printing apparatus includes a control unit 140 having a ROM 141 for storing operating programs necessary for controlling the apparatus, a RAM 142 for temporarily storing data and the like during a control operation, and a CPU 143 for performing logic operations. The control unit 140 has a driving circuit 145 connected thereto through an interface 144, for generating driving signals for application to the various driving devices of the apparatus. The printing apparatus is controlled by the control unit 140 to execute prepress and printing operations including the developing and fixing processes described hereinafter.

The control unit 140 acts also as a control device for causing roller rotating mechanisms to rotate developer feed rollers 66 with surfaces thereof slightly spaced from the surfaces of plates 7. This measure is taken in order to form an accumulation of the developer between the surface of each plate 7 and the surface of each developer feed roller 66 as described hereinafter.

Figure 7:
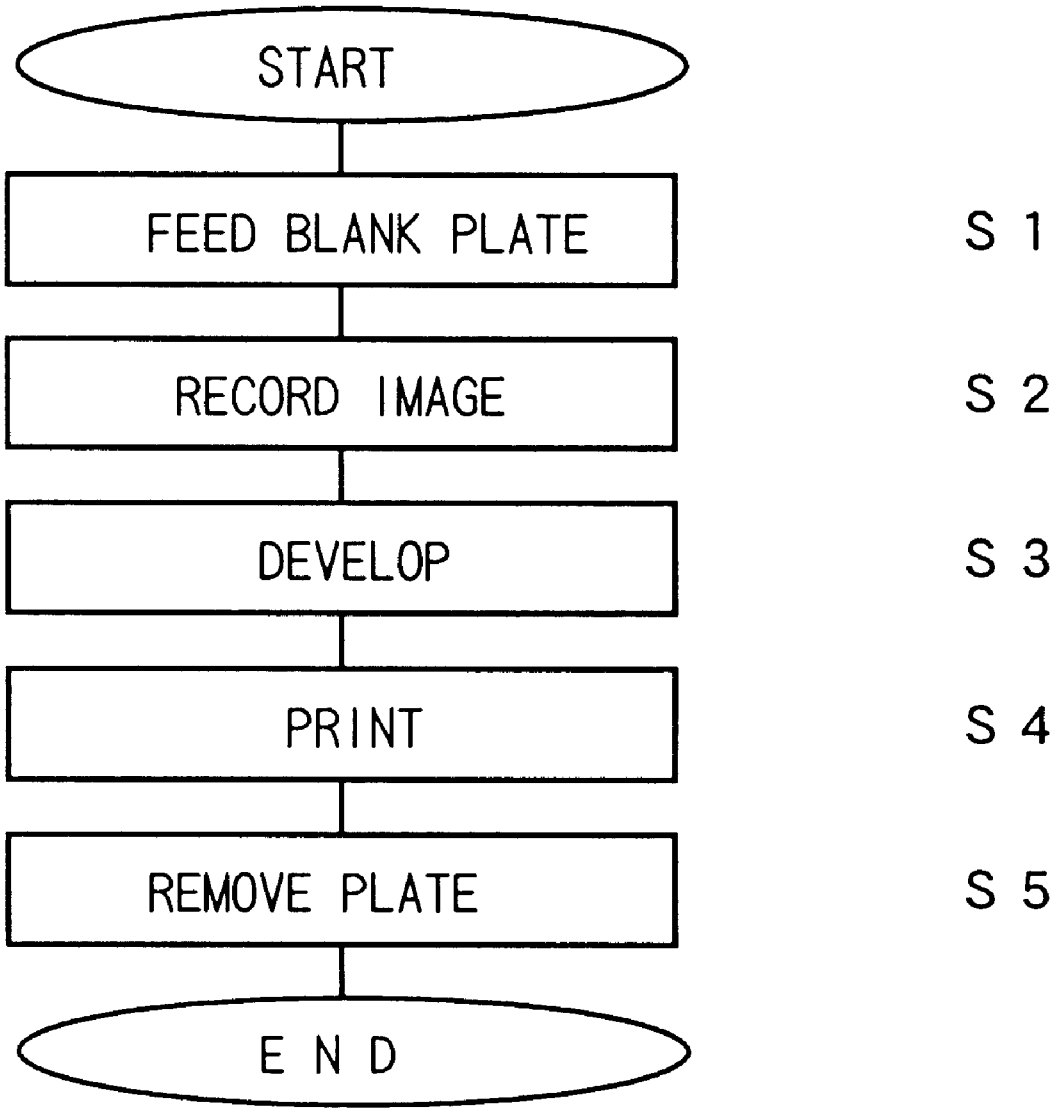
FIG. 7 is a flow chart showing prepress and printing operations of the printing apparatus.

Prepress and printing operations of the printing apparatus will be described next. FIG. 7 is a flow chart showing the prepress and printing operations of the printing apparatus.

First, plates 7 are fed to the peripheries of each of the plate cylinders 11 in the first printing unit 1 and second printing unit 2 (step S1). This plate feeding operation is carried out by the plate feed and remove mechanisms 13.

Next, images are recorded on the plates 7 mounted peripherally of each plate cylinder 11 (step S2). The image recording operation is carried out by irradiating the plates 7 mounted peripherally of the plate cylinder 11 with laser beams emitted from the LEDs of each image recorder 14.

Next, the plates 7 having the images recorded thereon are put to the developing and fixing processes (step S3). The developing and fixing processes are executed by the processing device 16 according to the present invention. The developing and fixing processes will be described in detail hereinafter.

The prepress operation for the plates 7 mounted peripherally of each plate cylinder 11 is completed with the image recording and processing operations noted above. Then, a printing operation is carried out (step S4). Specifically, the plates 7 on each plate cylinder 11 are fed with dampening water from the dampening water feed mechanisms 17, and inks from the ink feed mechanisms 15. The ink images on the plates 7 are transferred through the blanket cylinder 12 to the printing paper mounted peripherally of the impression cylinder 19.

Desired prints are made by continuing the above printing operation for a required time. Then, the plates 7 used are removed from each plate cylinder 11 (step S5) to complete the entire operation.

Figure 8:
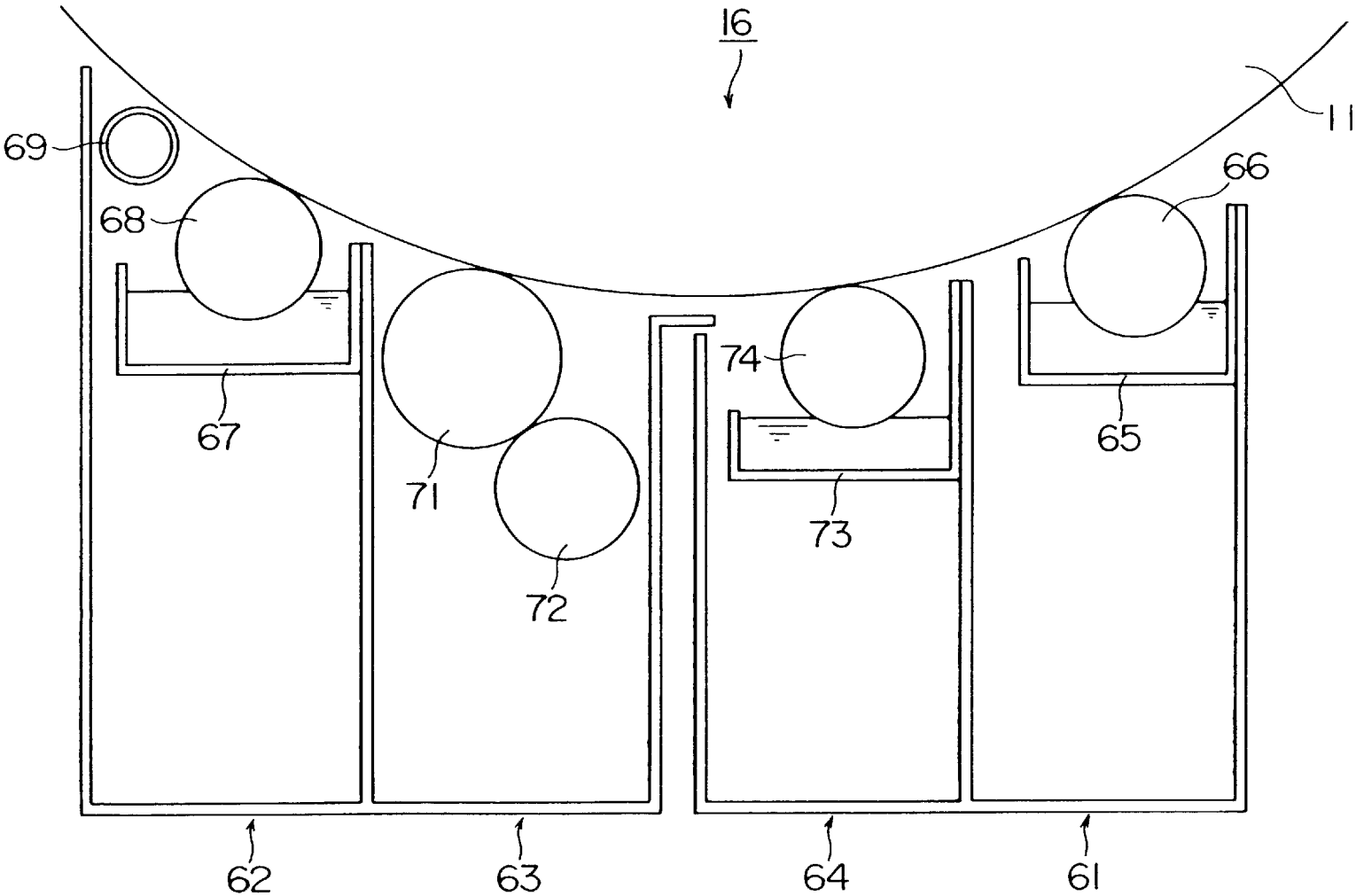
FIG. 8 is a schematic side view of a processing device.

The construction of processing device 16 which characterizes the present invention will be described next. FIG. 8 is a schematic side view of the processing device 16.

The processing device 16 includes a developing unit 61 for applying a developer to and developing the plates 7 mounted peripherally of each plate cylinder 11, a fixing unit 62 for applying a fixer to and fixing the images to the plates 7, a squeezing unit 63 for removing the developer and fixer from the plates 7, and a watering unit 64 for applying water to the surface of plate cylinder 11.

The developing unit 61, fixing unit 62, squeezing unit 63 and watering unit 64 are all movable by a lift mechanism and a moving mechanism, described hereinafter, between a processing position (shown in solid lines in FIG. 1), a lowered position and a withdrawn position (both shown in phantom lines in FIG. 1).

In this embodiment, lithographic plates using the diffusion transfer process (DTR process) are used as plates 7. The developer acts as an activator, and the fixer as a stabilizer. In this specification, a developing process and a fixing process are collectively called the developing process as necessary.

As shown in FIG. 8, the developing unit 61 includes a developer tank 65 for storing the developer, and a developer feed roller 66 with a lower portion thereof immersed in the developer stored in the developer tank 65. The fixing unit 62 includes a fixer tank 67 for storing the fixer, a fixer feed roller 68 with a lower portion thereof immersed in the fixer stored in the fixer tank 67, and a shower nozzle 69 for jetting the fixer to the fixer feed roller 68. The squeezing unit 63 includes a squeeze roller 71, and a brush roller 72 with peripheries thereof contacting the squeeze roller 71. The watering unit 64 includes a water feed roller 74 with a lower portion thereof immersed in the water stored in a water tank 73.

The developer feed roller 66 feeds the developer to the plates 7 mounted peripherally of the plate cylinder 11. The fixer feed roller 68 feeds the fixer to the plates 7 on the plate cylinder 11. The squeeze roller 71 removes the developer and fixer from the plates 7. The brush roller 72 cleans the squeeze roller 71 with a cleaning solution, such as a fixing solution.

Further, the water feed roller 74, though not playing an active role in the developing process, supplies water to the surface of plate cylinder 11 before the plates 7 are placed thereon in order to enhance contact of the plates 7 with the cylinder 11.

The developer feed roller 66 and fixer feed roller 68 are distributed to opposite positions across the lower end of plate cylinder 11, with the upper ends of the two rollers 66 and 68 located above the lower end of plate cylinder 11. This is an optimal arrangement for the plates 7 mounted peripherally of the plate cylinder 11 to be contactable by the developer feed roller 66 for feeding the developer from the developer tank 65 and by the fixer feed roller 68 for feeding the fixer from the fixer tank 67.

Each of the developer feed roller 66, fixer feed roller 68 and water feed roller 74 is movable by a roller moving mechanism, described hereinafter, between a processing position adjacent the plates 7 mounted on the plate cylinder 11, and a retracted position away from the plates 7. Further, the developer feed roller 66, fixer feed roller 68 and water feed roller 74 are rotatable synchronously with one another by a roller rotating mechanism described hereinafter.

Figure 9:
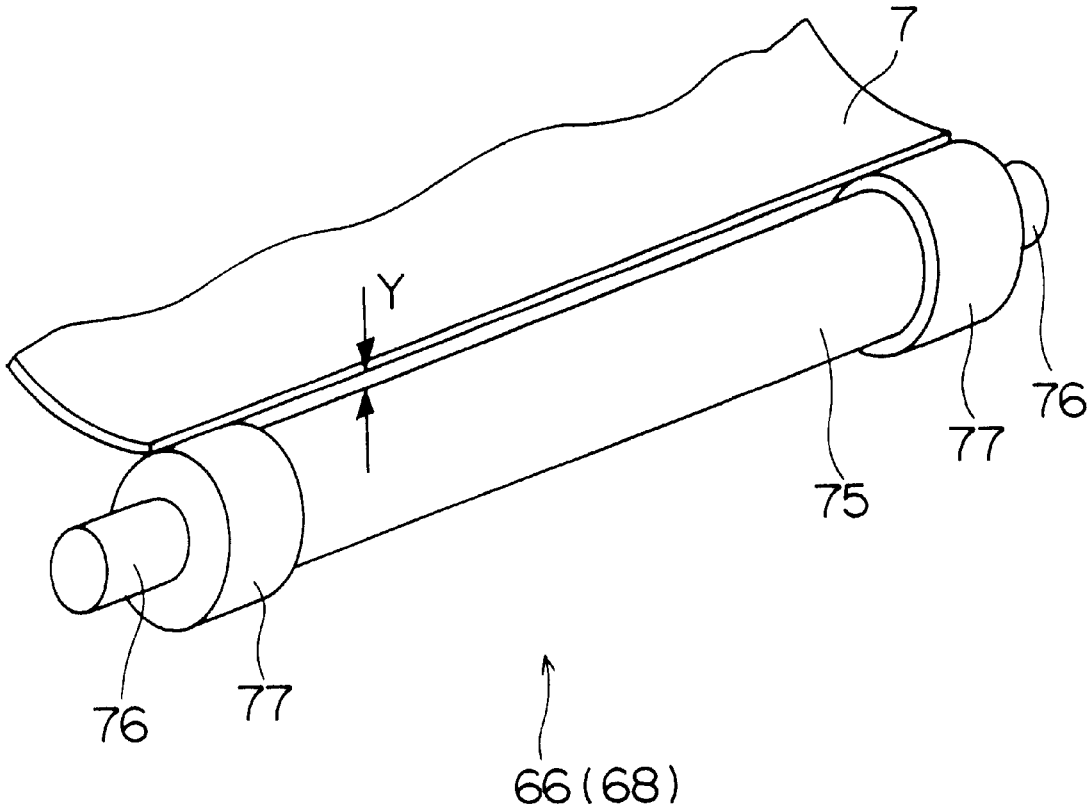
FIG. 9 is a perspective view showing a relationship between a developer feed roller (or fixer feed roller) and a printing plate mounted peripherally of the plate cylinder.
Figure 10:
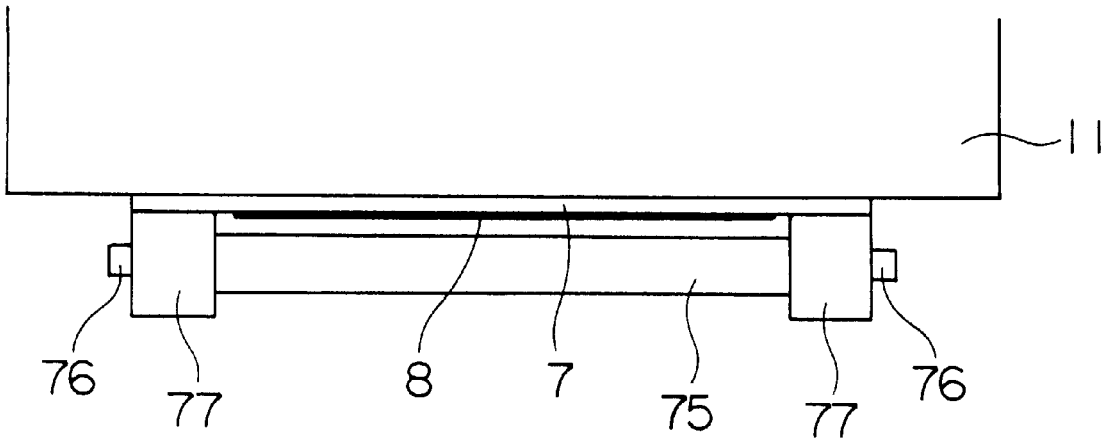
FIG. 10 is a front view showing the relationship between the developer feed roller (or fixer feed roller) and the printing plate mounted peripherally of the plate cylinder.

FIG. 9 is a perspective view showing a relationship between the developer feed roller 66 (or fixer feed roller 68) and a plate 7 mounted peripherally of the plate cylinder 11. FIG. 10 is a front view showing this relationship. The developer feed roller 66 and fixer feed roller 88 have the same construction. Thus, the following description will be made only in relation to the developer feed roller 66. The plate cylinder 11 is omitted from FIG. 9.

The developer feed roller 66 includes a main roller body 75 and a shaft 76. The main roller body 75 has a pair of positioning elements 77 mounted on opposite end portions thereof to act as a positioning mechanism. The positioning elements 77 are in the form of cylindrical members having a larger outside diameter than the main roller body 75 and coaxially mounted thereon.

Consequently, when the developer feed roller 66 contacts the plate 7 mounted peripherally of the plate cylinder 11, the surface of main roller body 75 of developer feed roller 66 is spaced from the surface of plate 7 by a slight distance Y. That is, a gap Y as shown in FIG. 9 exists between the surface of main roller body 75 of developer feed roller 66 and the surface of plate 7.

The above positioning elements 77 are arranged to contact the surface of plate 7 in regions (indicated by arrows b in FIG. 5) between the side edges of plate 7 and the side edges of image area 8.

With the developer feed roller 66 having the above construction, the main roller body 75 and image area 8 are spaced from each other by distance Y. The outside diameter of positioning elements 77 is set so that this distance Y has a very small value. Thus, the developer picked up from the developer tank 65 by the developer feed roller 66 may be applied to the surface of plate 7 by capillary action.

At this time, the main roller body 75 of developer feed roller 66 and the image area 8 of plate 7 are not in direct contact with each other. Consequently, the image area 8 is free from the rubbing action of developer feed roller 66 which could result in a processing unevenness due to vibration of developer feed roller 66. It is also possible effectively to avoid an imperfect deposition of silver which could occur when silver deposits formed immediately after the developer is fed are rubbed by the developer feed roller 66.

It is desirable that the above slight distance Y is in the order of 0.1 mm to 1.0 mm, and preferably 0.3 mm to 0.6 mm.

Figure 11:
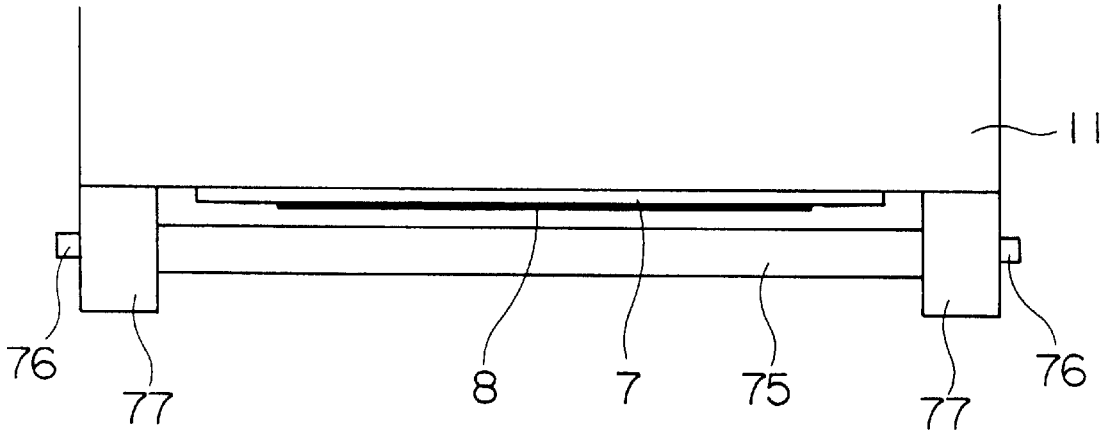
FIG. 11 is a front view showing a relationship between a developer feed roller (or fixer feed roller) and a printing plate mounted peripherally of the plate cylinder in another embodiment.

FIG. 11 is a front view showing a relationship between the developer feed roller 66 (or fixer feed roller 68) and a plate 7 mounted peripherally of the plate cylinder 11 in another embodiment.

In the embodiment shown in FIGS. 9 and 10, the positioning elements 77 contact the surface of plate 7 in the regions between the side edges of plate 7 and the side edges of the image area 8. In the embodiment shown in FIG. 11, on the other hand, the positioning elements 77 contact regions of the plate cylinder 11 outwardly of the opposite sides of plate 7. The embodiment shown in FIG. 11 is, as is the embodiment shown in FIGS. 9 and 10, effective to avoid a deterioration in quality of the developing process resulting from the image area 8 contacting the positioning elements 77.

Figure 12:
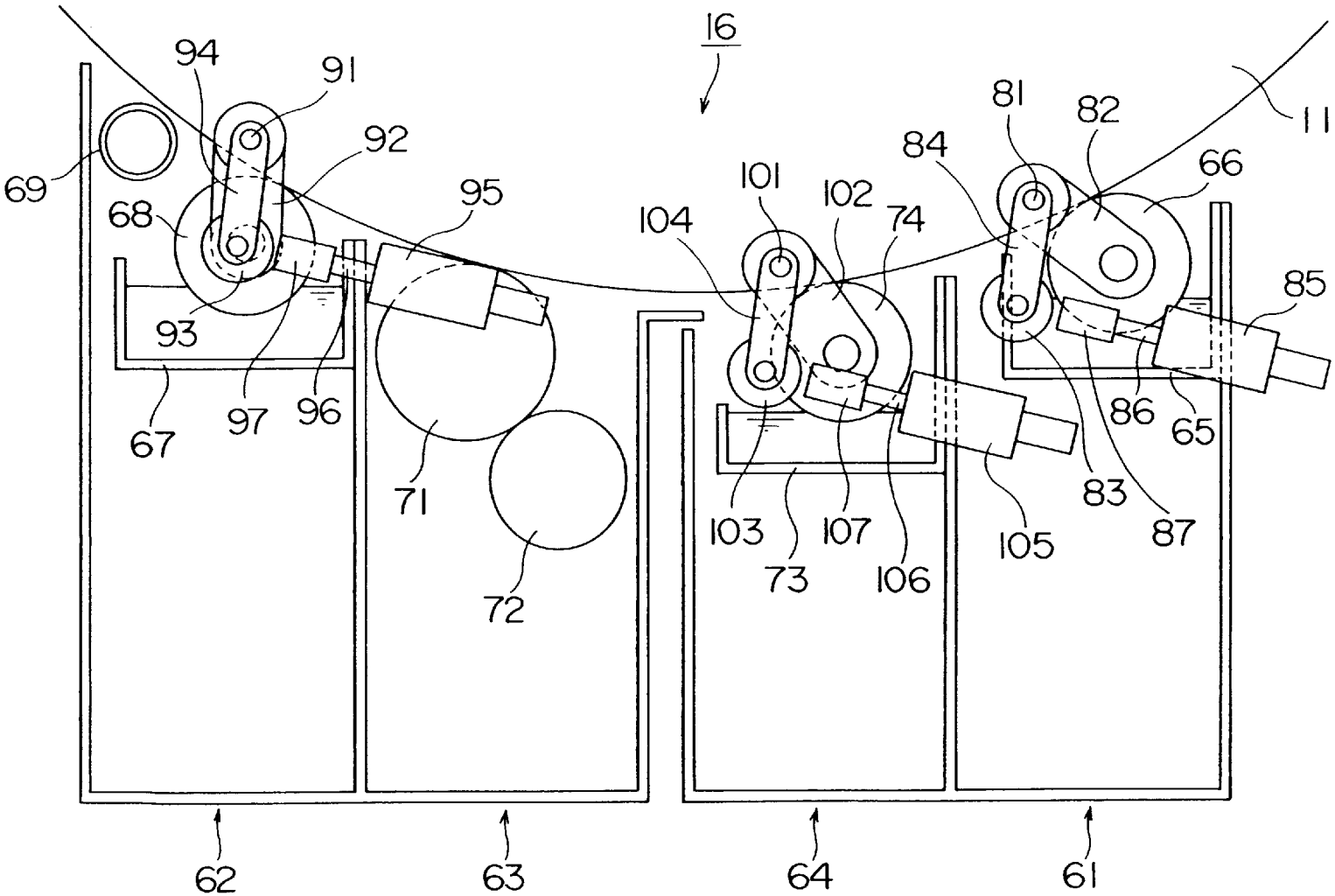
FIG. 12 is a schematic view of roller moving mechanisms.
Figure 13:
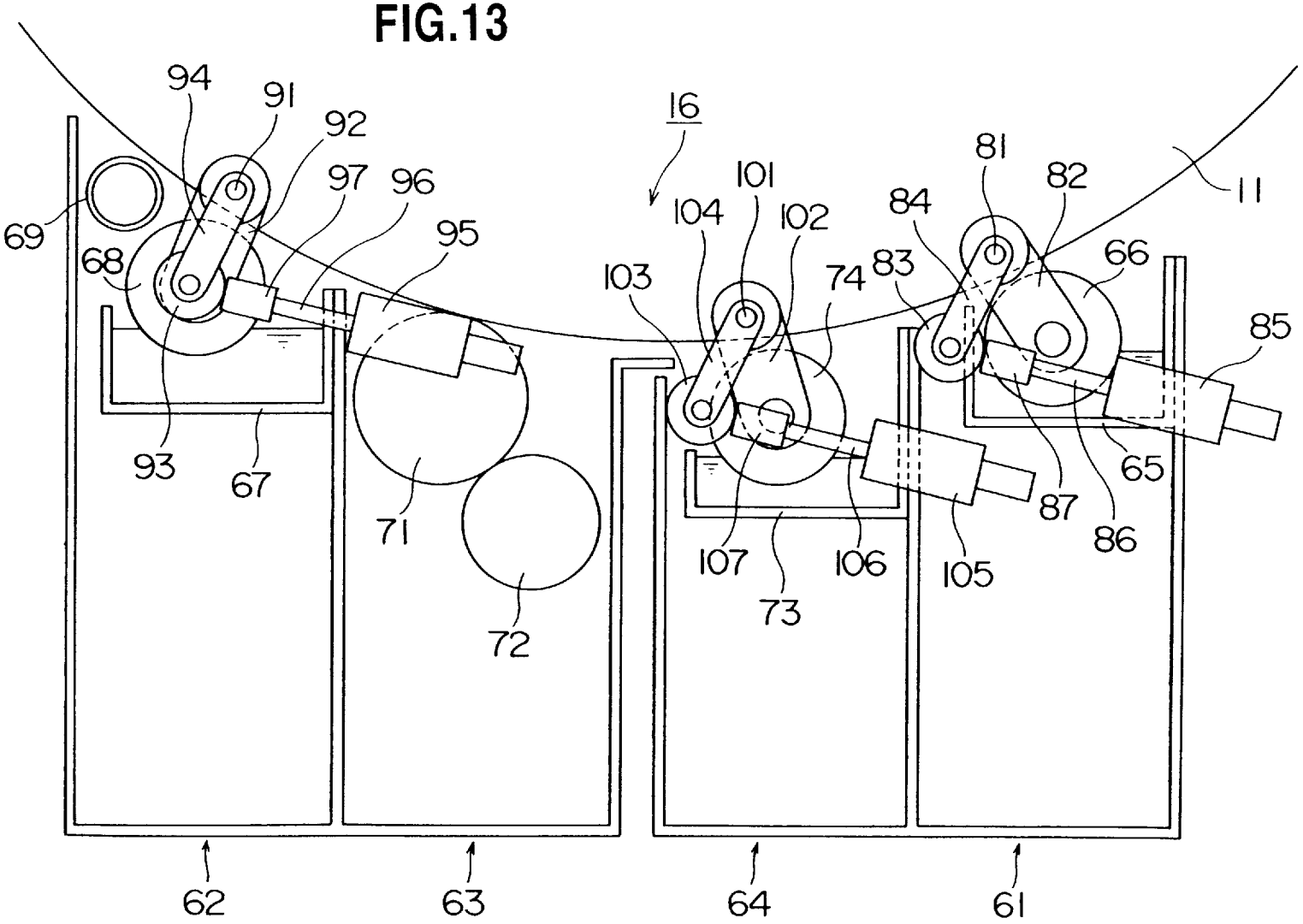
FIG. 13 is another schematic view of the roller moving mechanisms.

The constructions of the roller moving mechanisms will be described next. These roller moving mechanisms move the developer feed roller 66, fixer feed roller 68 and water feed roller 74 between the processing position adjacent the plates 7 mounted on the plate cylinder 11, and the retracted position away from the plates 7, respectively. FIGS. 12 and 13 are schematic views of the roller moving mechanisms.

The developer feed roller 66 is rotatably supported by arms 82 pivotable about an axis 81 disposed on a main body of the printing apparatus. One of the arms 82 has an arm 84 fixed thereto, with a cam follower 83 attached to a distal end of arm 84. The main body of the printing apparatus supports an air cylinder 85 with a cylinder rod 86 extendible to cause a distal end 87 thereof to press the cam follower 83. The arms 82 are biased, by a spring not shown, in a direction to move the developer feed roller 66 toward the plate cylinder Thus, when the cylinder rod 86 of air cylinder 85 is retracted to move the distal end 87 away from the cam follower 83, as shown in FIG. 12, the developer feed roller 66 is moved to the processing position where the surface of roller 66 (or, strictly speaking, the surfaces of positioning elements 77 mounted on the developer feed roller 66) contacts the plate cylinder 11. When the cylinder rod 86 of air cylinder 85 is extended to cause the distal end 87 to press the cam follower 83, as shown in FIG. 13, the developer feed roller 66 is moved to the retracted position where the surface of roller 66 (or, strictly speaking, the surfaces of positioning elements 77 mounted on the developer feed roller 66) is separated from the plate cylinder 11.

Similarly, the fixer feed roller 68 is rotatably supported by arms 92 pivotable about an axis 91 disposed on the main body of the printing apparatus. One of the arms 92 has an arm 94 fixed thereto, with a cam follower 93 attached to a distal end of arm 94. The main body of the printing apparatus supports an air cylinder 95 with a cylinder rod 96 extendible to cause a distal end 97 thereof to press the cam follower 93. The arms 92 are biased, by a spring not shown, in a direction to move the fixer feed roller 68 toward the plate cylinder 11.

Thus, when the cylinder rod 96 of air cylinder 95 is retracted to move the distal end 97 away from the cam follower 93, as shown in FIG. 12, the fixer feed roller 68 is moved to the processing position where the surface of roller 68 (or, strictly speaking, the surfaces of positioning elements 77 mounted on the fixer feed roller 68) contacts the plate cylinder 11. When the cylinder rod 96 of air cylinder 95 is extended to cause the distal end 97 to press the cam follower 93, as shown in FIG. 13, the fixer feed roller 68 is moved to the retracted position where the surface of roller 68 (or, strictly speaking, the surfaces of positioning elements 77 mounted on the fixer feed roller 68) is separated from the plate cylinder 11.

The water feed roller 74 is rotatably supported by arms 102 pivotable about an axis 101 disposed on the main body of the printing apparatus. One of the arms 102 has an arm 104 fixed thereto, with a cam follower 103 attached to a distal end of arm 104. The main body of the printing apparatus supports an air cylinder 105 with a cylinder rod 106 extendible to cause a distal end 107 thereof to press the cam follower 103. The arms 102 are biased, by a spring not shown, in a direction to move the water feed roller 74 toward the plate cylinder 11.

Thus, when the cylinder rod 106 of air cylinder 105 is retracted to move the distal end 107 away from the cam follower 103, as shown in FIG. 12, the water feed roller 74 is moved to the processing position where the surface of roller 74 contacts the plate cylinder 11. When the cylinder rod 106 of air cylinder 105 is extended to cause the distal end 107 to press the cam follower 103, as shown in FIG. 13, the water feed roller 74 is moved to the retracted position where the surface of roller 74 is separated from the plate cylinder 11.

The construction of the roller rotating mechanism will be described next. This roller rotating mechanism synchronously rotates the developer feed roller 66, fixer feed roller 68 and water feed roller 74.

Figure 14:
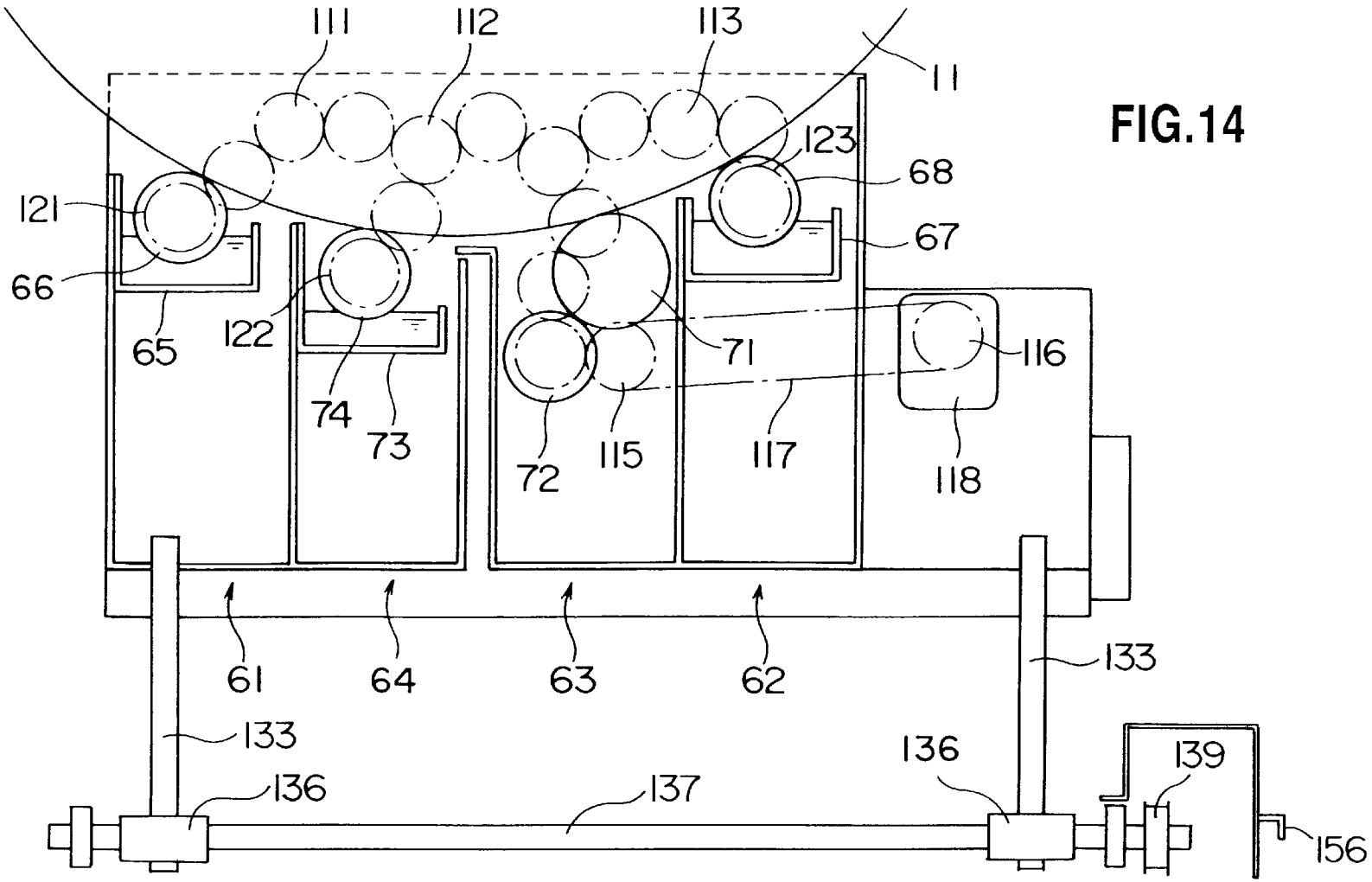
FIG. 14 is a side view showing an outline of a roller rotating mechanism.
Figure 15:
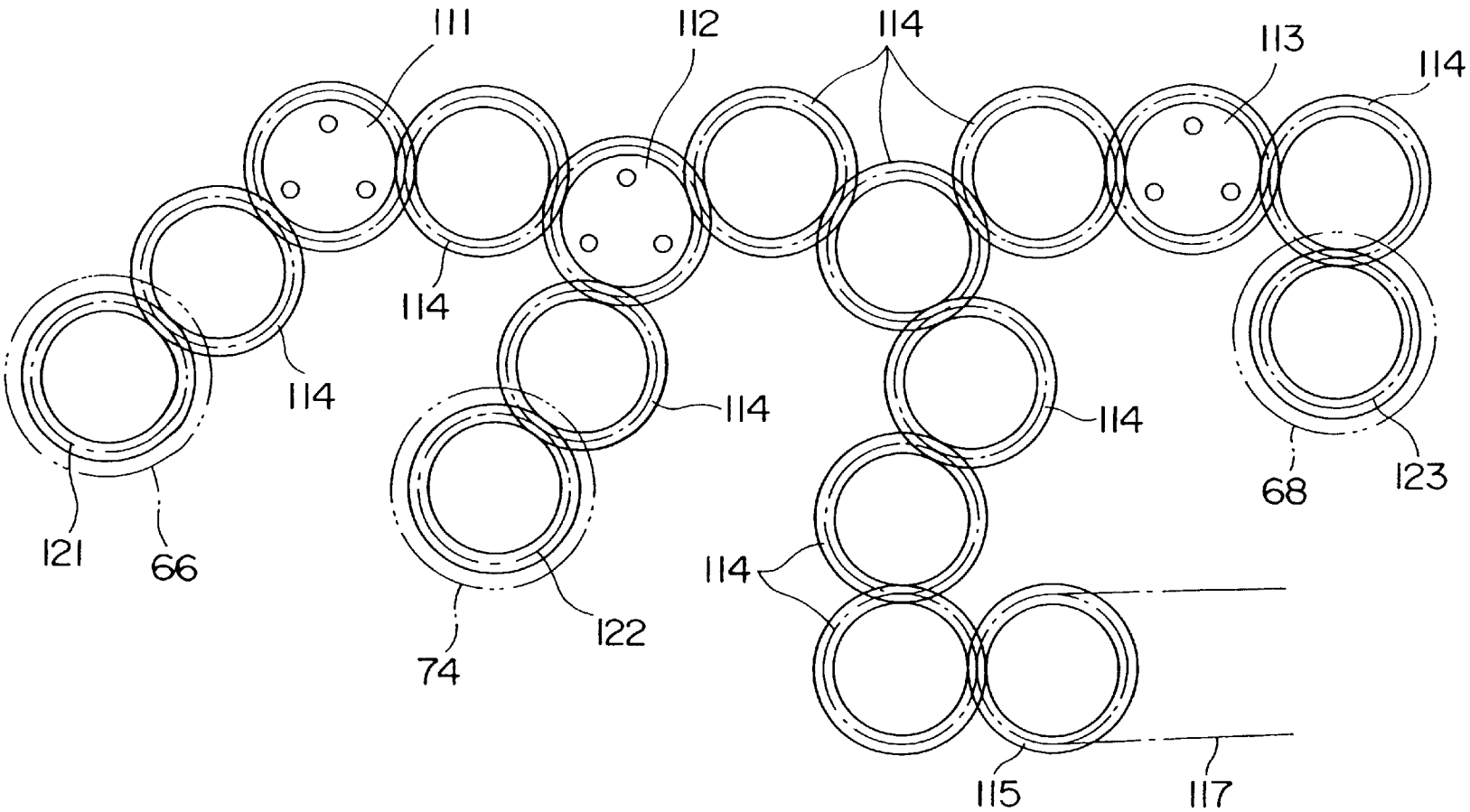
FIG. 15 is a side view showing various gears included in the roller rotating mechanism.
Figure 16:
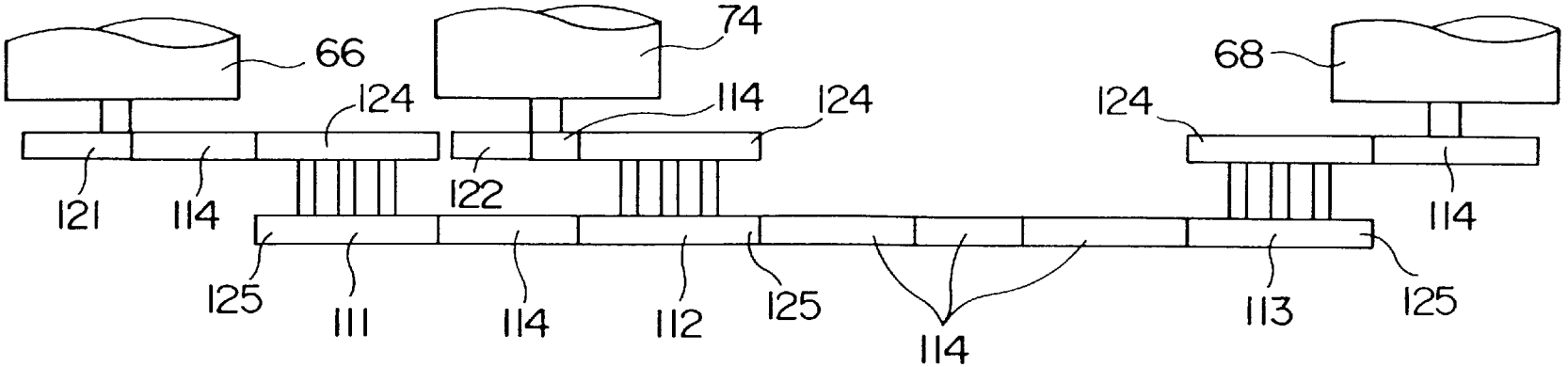
FIG. 16 is a plan view showing the various gears included in the roller rotating mechanism.

FIG. 14 is a side view showing an outline of the roller rotating mechanism. FIG. 15 is a side view showing various gears 111, 112, 113, 114, 115, 121, 122 and 123 included in the roller rotating mechanism. FIG. 16 is a plan view of these gears. FIGS. 14 and 15 show the opposite side of what is shown in FIGS. 1 and 12.

This roller rotating mechanism includes a roller gear 121 disposed coaxially with the developer feed roller 66, a roller gear 123 disposed coaxially with the fixer feed roller 68, a roller gear 122 disposed coaxially with the water feed roller 74, a drive gear 115 connected through a chain 117 to a gear 116 mounted on a drive shaft of a motor 118, three double gear mechanisms 111, 112 and 113, and a plurality of drive transmission gears 114.

Figure 17:
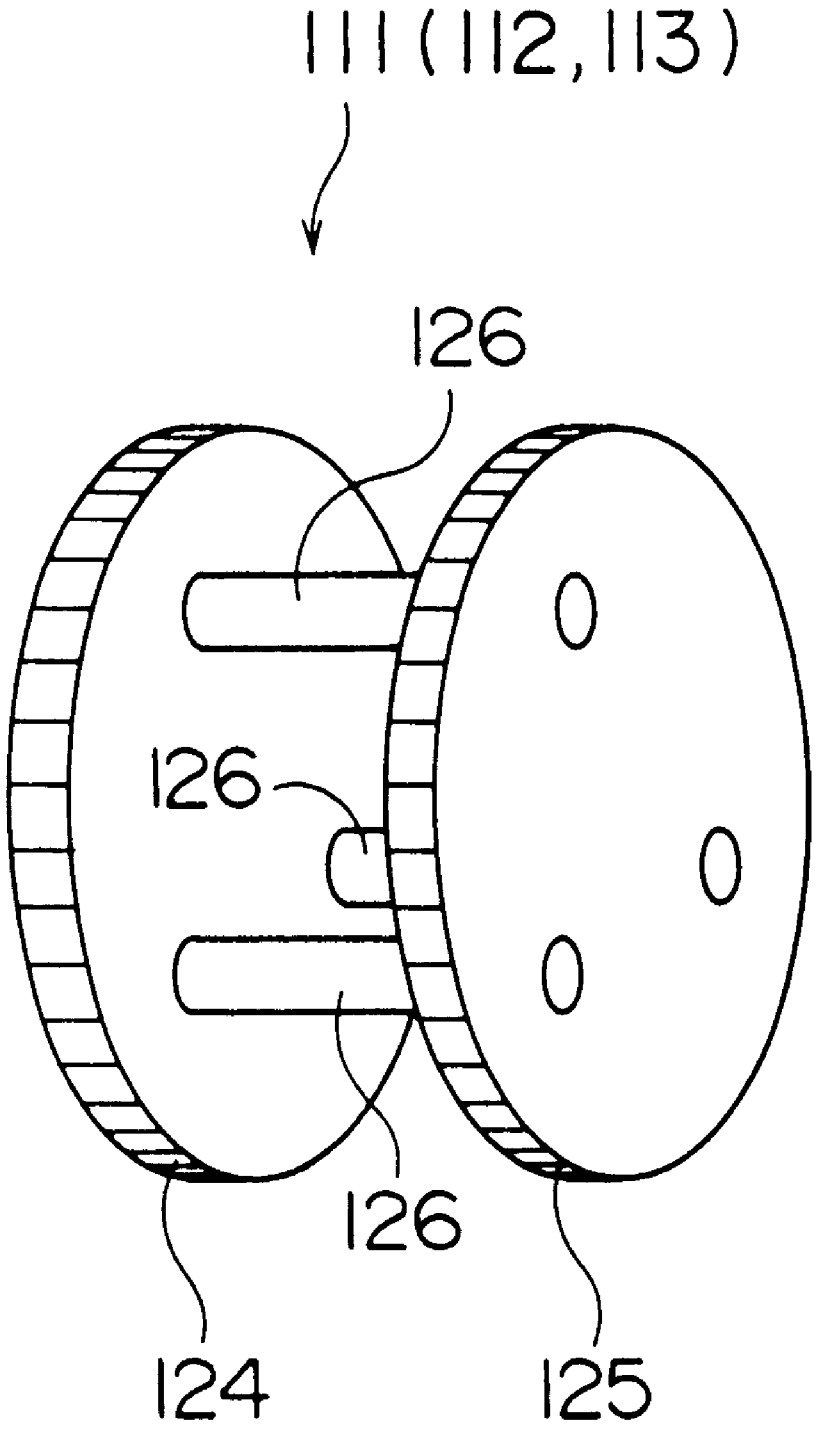
FIG. 17 is a perspective view of a double gear mechanism.

As shown in FIG. 17, the double gear mechanism 111 includes a first gear 124, a second gear 125, and three connecting members 126 extending between eccentric positions of the first gear 124 and second gear 125 to interconnect these gears 124 and 125 to be coaxial with each other. The double gear mechanism 112 and double gear mechanism 113 have the same construction as the double gear mechanism 111.

The first gear 124 of double gear mechanism 111 is connected through one drive transmission gears 114 to the roller gear 121 disposed coaxially with the developer feed roller 66. The second gear 125 of double gear mechanism 111 is connected through another drive transmission gear 114 to the second gear 125 of double gear mechanism 112.

The first gear 124 of double gear mechanism 112 is connected through one drive transmission gear 114 to the roller gear 122 disposed coaxially with the water feed roller 74. The second gear 125 of double gear mechanism 112 is connected through three drive transmission gears 114 to the second gear 125 of double gear mechanism 113.

The first gear 124 of double gear mechanism 113 is connected with through one drive transmission gear 114 to the roller gear 123 disposed coaxially with the fixer feed roller 6.

Further, the drive transmission gears 114 connecting the double gear mechanism 112 to the double gear mechanism 113 are connected to the drive gear 115 through other drive transmission gears 114.

In the roller rotating mechanism having the above construction, the drive of drive gear 115 connected through the chain 117 to the gear 116 mounted on the drive shaft of motor 118 is transmitted to the roller gears 121, 122 and 123 through the plurality of drive transmission gears 114 and three double gear mechanisms 111, 112 and 113. As a result, the developer feed roller 66, fixer feed roller 68, and water feed roller 74 rotate synchronously with one another.

As noted above, each of the double gear mechanisms 111, 112 and 113 has the first gear 124, second gear 125, and three connecting members 126 extending between eccentric positions of the first gear 124 and second gear 125 to interconnect these gears 124 and 125 to be coaxial with each other. A liquid such as the developer, fixer or water adhering to the first gear 124 of each double gear mechanism 111, 112 or 113 will be scattered therefrom under centrifugal force since the first gear 124 and second gear 125 are not interconnected in their axial regions. Thus, the liquid is not transferred to the second gear 125 via the connecting members 126.

Consequently, even when a liquid such as the developer, fixer or water adheres to the first gear 124, the liquid is effectively prevented from reaching the other gears by way of the second gear 125. If the fixer should pass from the fixer feed roller 68 through the plurality of gears and developer feed roller 66 into the developer, the developer would deteriorate to become unable to process the plates. The above construction is effective to avoid such an inconvenience.

In the above embodiment, the roller rotating mechanism synchronously rotates the developer feed roller 66 and fixer feed roller 68. However, this roller rotating mechanism is dispensable. Where no such mechanism is provided, the rotation of plate cylinder 11 may be transmitted to the developer feed roller 66 and fixer feed roller 68 through the positioning elements 77, thereby rotating the developer feed roller 66 and fixer feed roller 68 synchronously with the plate cylinder 11.

Figure 18:
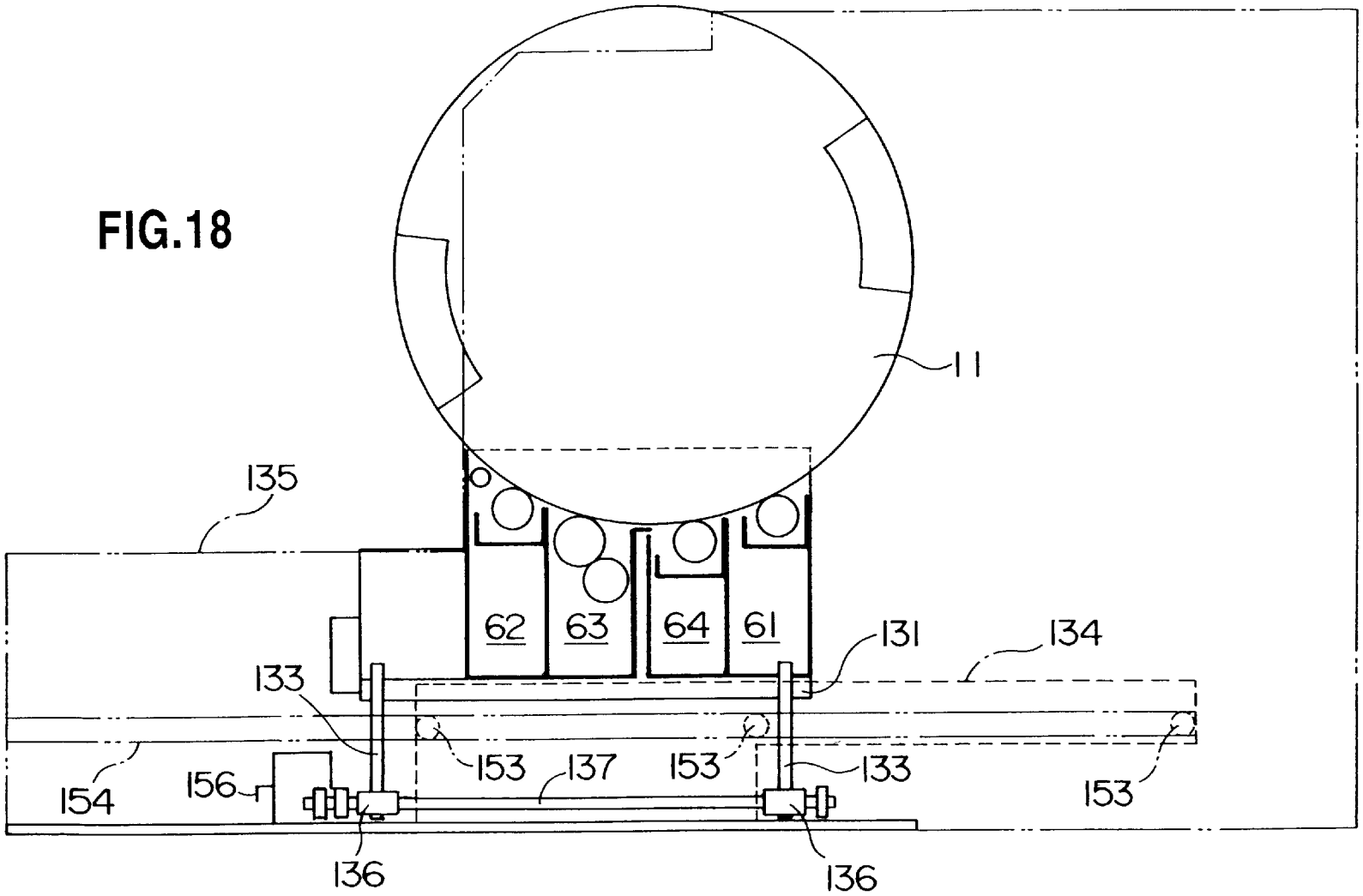
FIG. 18 is a side view of a lift mechanism and a moving mechanism.
Figure 19:
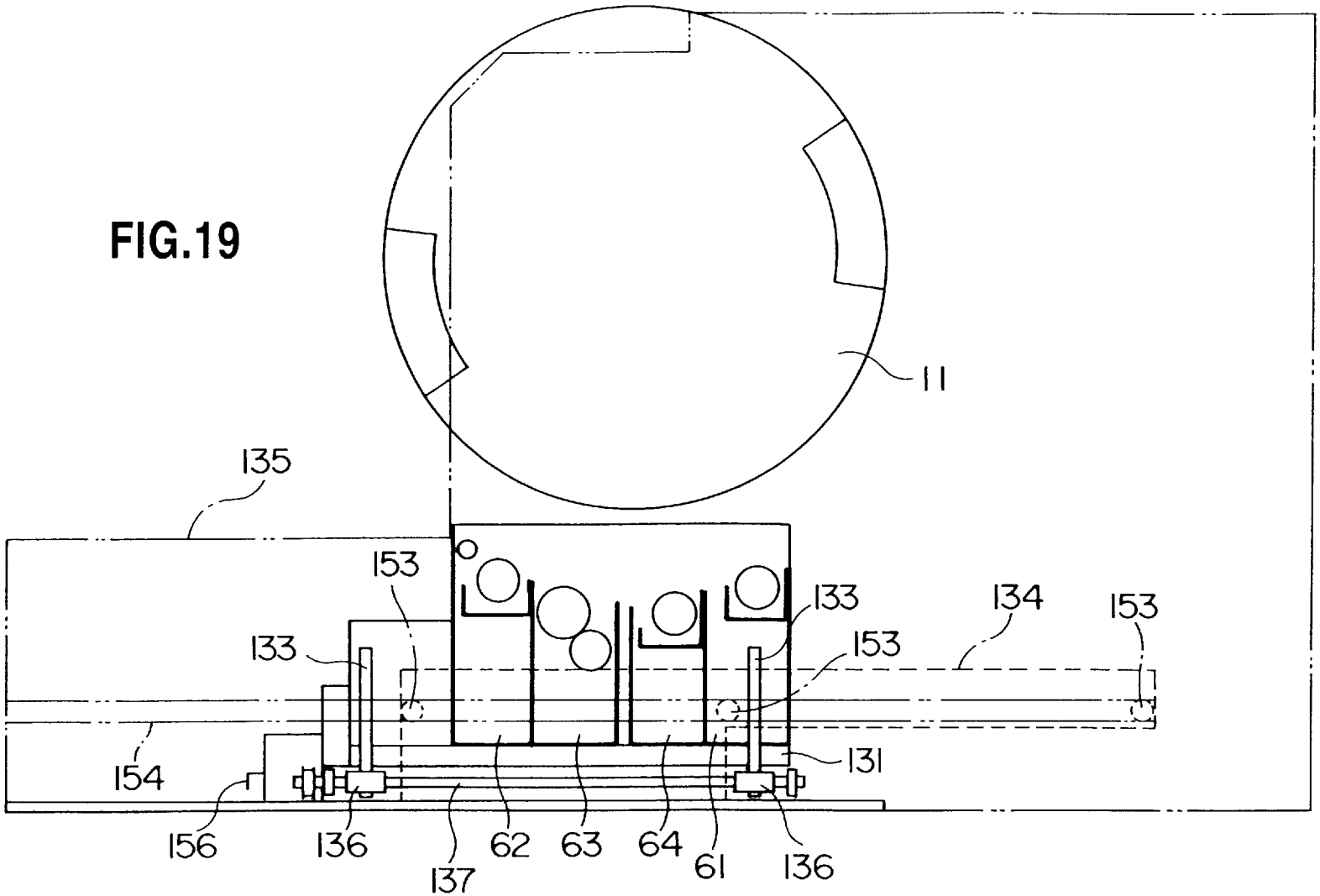
FIG. 19 is another side view of the lift mechanism and moving mechanism.
Figure 20:
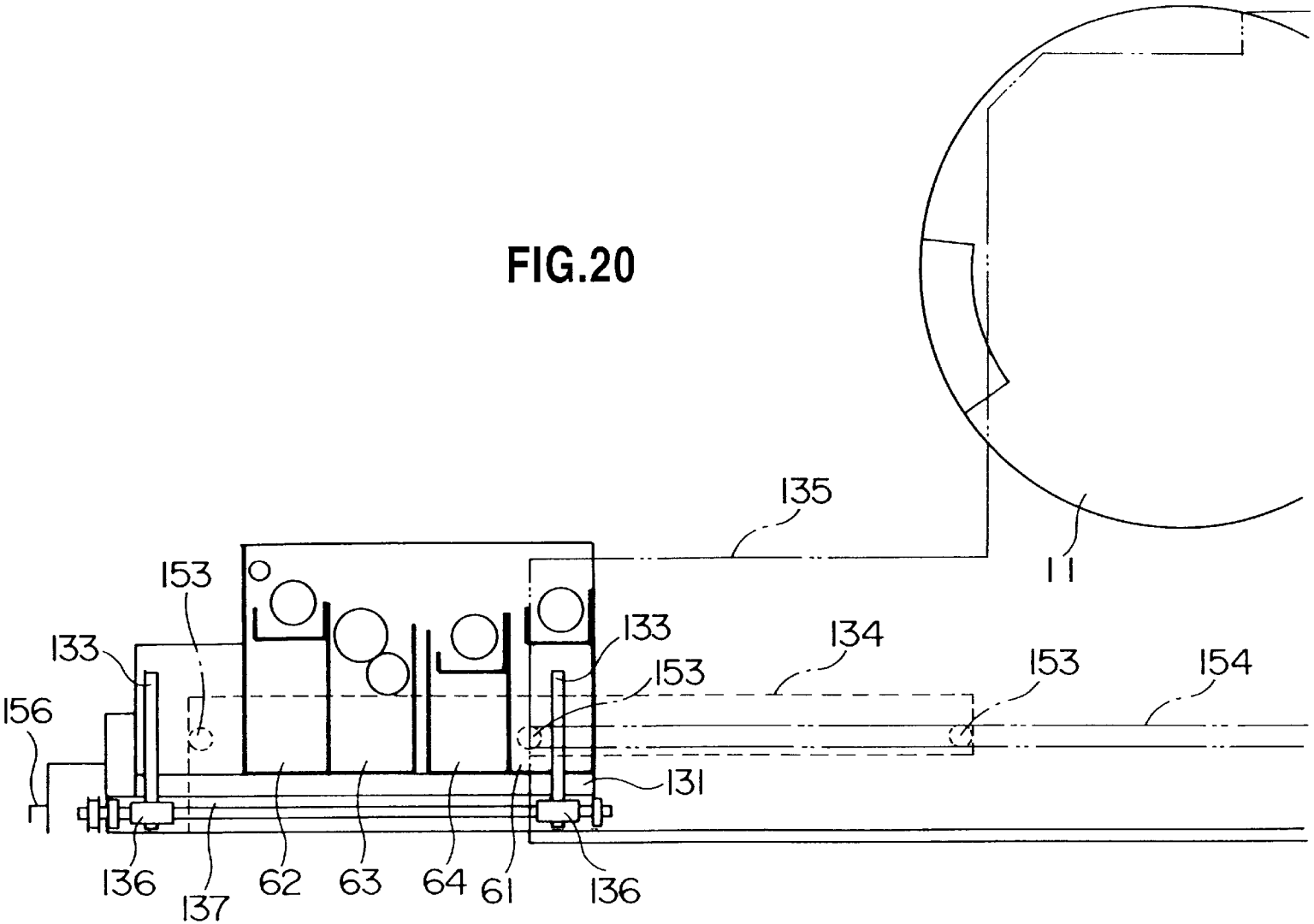
FIG. 20 is a further side view of the lift mechanism and moving mechanism.

The constructions of the lift mechanism and moving mechanism will be described next. These lift mechanism and moving mechanism move the processing device 16 including the developing unit 61, fixing unit 62, squeezing unit 63 and watering unit 64, between the processing position, lowered position and withdrawn position. FIGS. 18 through 20 are side views showing the lift mechanism and moving mechanism.

FIG. 18 shows the processing device 16 in the processing position. FIG. 19 shows the processing device 16 in the lowered position. FIG. 20 shows the processing device 16 in the withdrawn position.

As shown in FIGS. 18 through 20, the developing unit 61, fixing unit 62, squeezing unit 63 and watering unit 64 are supported by a single support deck 131. The support deck 131 has four nuts 132 (see FIG. 22 to be described hereinafter). The nuts 132 are meshed with vertical drive screws 133 of the lift mechanism, respectively.

Figure 21:
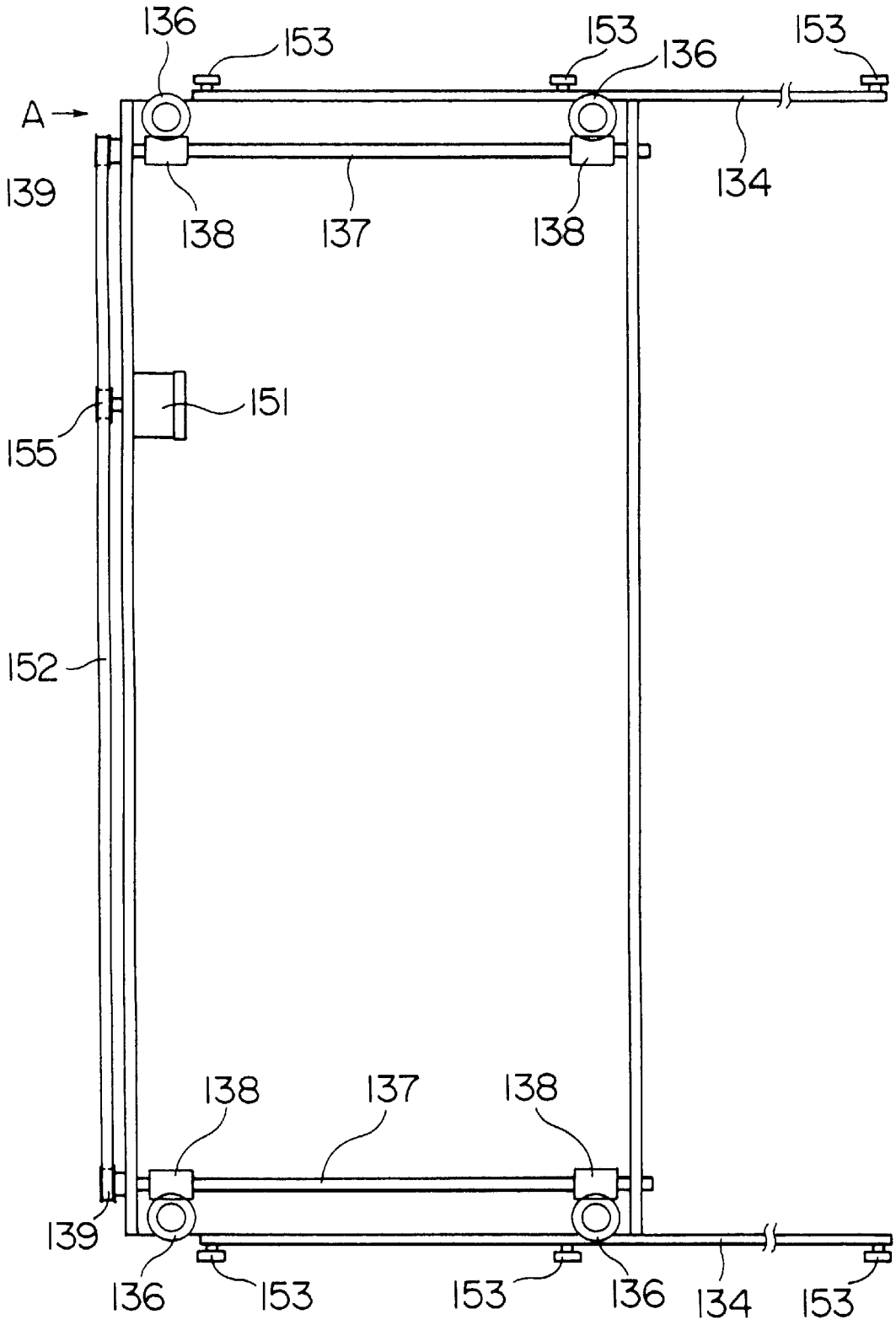
FIG. 21 is a plan view of a principal portion of the lift mechanism.
Figure 22:
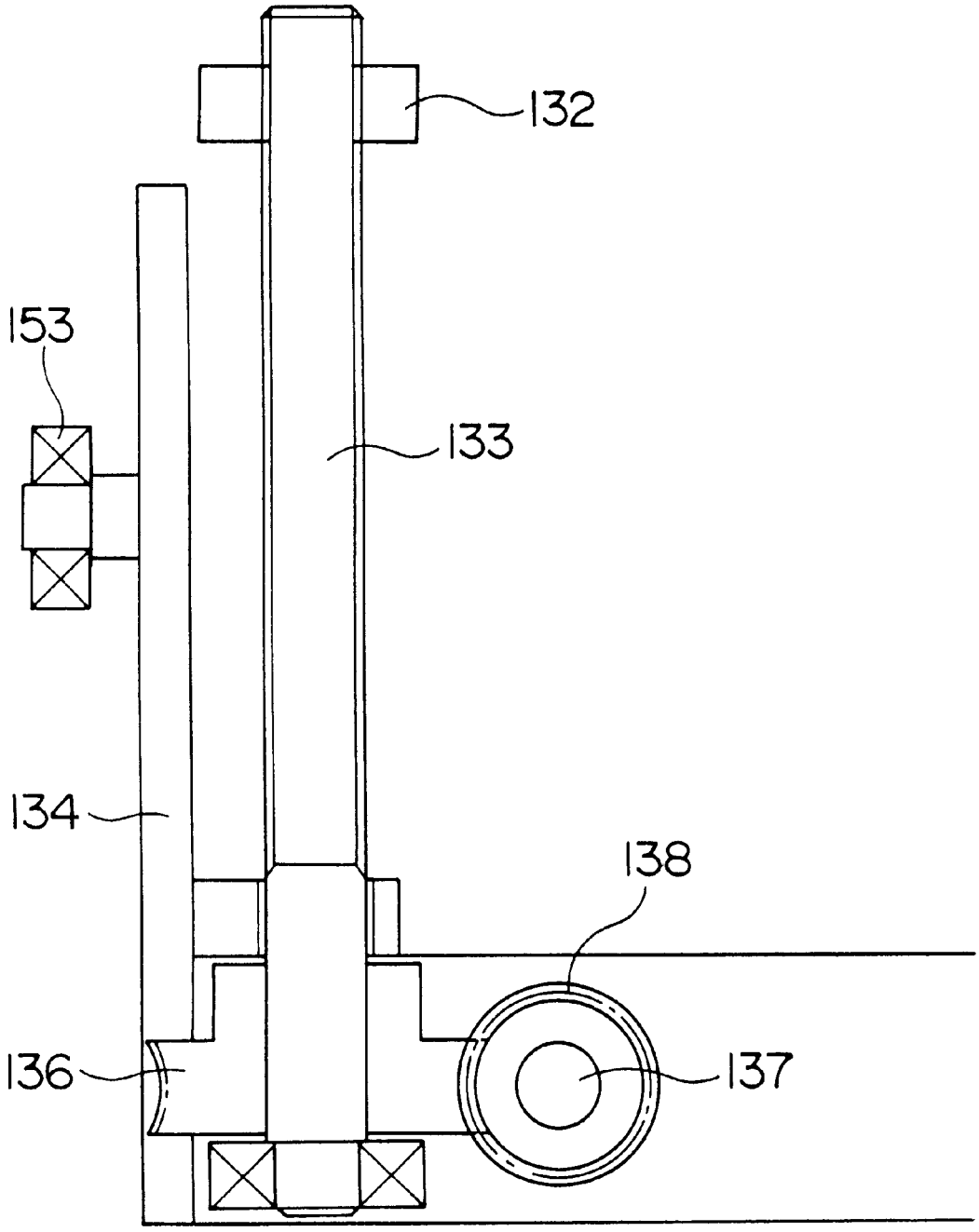
FIG. 22 is an enlarged view of a portion of the lift mechanism seen from the direction of arrow A in FIG. 21.

FIG. 21 is a plan view of a principal portion of the lift mechanism. FIG. 22 is an enlarged view of a portion of the lift mechanism seen from the direction of arrow A in FIG. 21.

The vertical drive screws 133 of the lift mechanism are supported by a pair of right and left support plates 134. Each drive screw 133 has a worm wheel 136 fixed to a proximal end thereof. A pair of rotary shafts 137 are arranged between the right and left support plates 134. Each rotary shaft 137 has a pair of worms 138 mounted on opposite end portions thereof and meshed with the worm wheels 136.

Each rotary shaft 137 further includes a pulley 139 attached to a forward end thereof. The pulleys 139 are connected through a belt 152 to a pulley 155 attached to a rotary shaft of a motor 151. Thus, the pair of rotary shafts 136 are synchronously rotatable by the drive of motor 151. With the rotation of rotary shafts 136, the four vertical drive screws 133 rotate synchronously with one another.

As noted above, the vertical drive screws 133 are meshed with the nuts 132 of the support deck 131 supporting the developing unit 61, fixing unit 62, squeezing unit 63 and watering unit 64. Thus, as the vertical drive screws 133 are 20 rotated by the drive of motor 151, the support deck 131 is moved up and down, along with the developing unit 61, fixing unit 62, squeezing unit 63 and watering unit 64, between the processing position shown in FIG. 18 and the lowered position shown in FIG. 19.

As shown in FIGS. 18 through 22, each of the right and left support plates 134 has three bearings 153 projecting therefrom. On the other hand, as shown in FIGS. 18 through 20, guide grooves 154 are formed in a pair of right and left side plates 135 of the main body of the printing apparatus for supporting the plate cylinder 11. The bearings 153 are fitted in the guide grooves 154 to run therealong.

With the above construction, the developing unit 61, fixing unit 62, squeezing unit 63 and watering unit 64 are reciprocable, along with the right and left support plates 134, between the lowered position shown in FIG. 19 and the withdrawn position shown in FIG. 20. The bearings 153 and guide grooves 154 constitute the moving mechanism for moving the processing device 16 between the lowered position and the withdrawn position.

For moving the developing unit 61, fixing unit 62, squeezing unit 63 and watering unit 64 from the processing position shown in FIG. 18 to the withdrawn position shown in FIG. 20, these units 61–64 are first moved by the drive of motor 151 to the lowered position shown in FIG. 19. Subsequently, the operator, by pulling a handle 156, moves the developing unit 61, fixing unit 62, squeezing unit 63 and watering unit 64 from the lowered position shown in FIG. 19 to the withdrawn shown in FIG. 20.

The developing unit 61, fixing unit 62, squeezing unit 63 and watering unit 64 are moved in two stages as described above. This is necessary because the developer feed roller 66 and fixer feed roller 68 are arranged in opposite positions across the lower end of plate cylinder 11, with the upper ends of the two rollers 66 and 68 located above the lower end of plate cylinder 11.

Next, a processing operation of the processing device 16 having the above construction will be described next. The following operation is performed under control of the control unit 140.

In time of starting a developing operation immediately following completion of an operation of the image recorder 14 to record an image on one of the plates 7 mounted peripherally of plate cylinder 11, the processing device 16 including the developing unit 61, fixing unit 62, squeezing unit 63 and watering unit 64 lies in the lowered position shown in FIG. 19.

Figure 23:
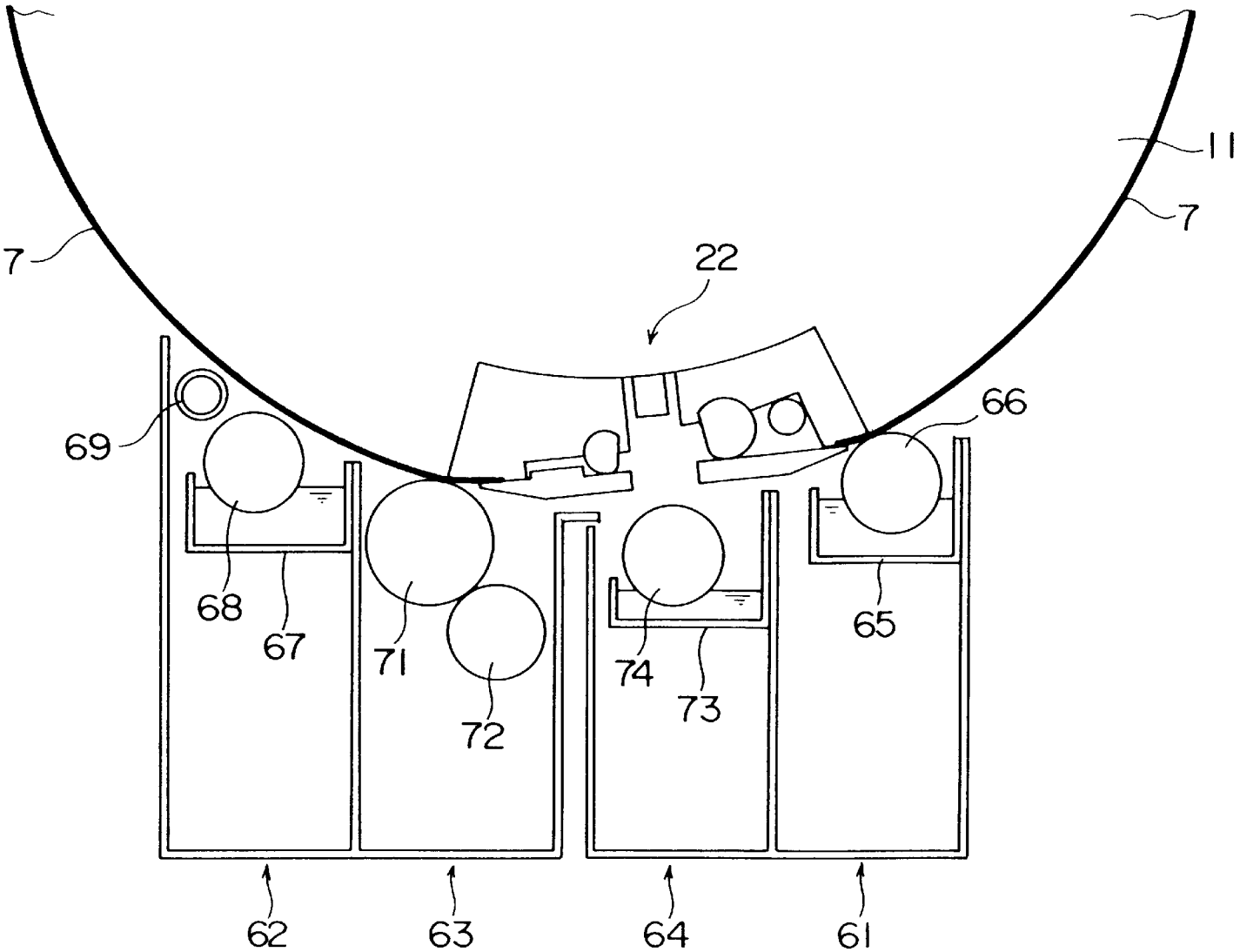
FIG. 23 is an explanatory view showing a developing operation.

In this state, the plate cylinder 11 is first rotated at low speed for processing of one of the plates 7 mounted thereon. The plate cylinder 11 is stopped in a position where the forward end of plate 7 mounted thereon may be opposed to the developer feed roller 66. Subsequently, the motor 151 of the lift mechanism is operated to raise the processing device 16 to the processing position. The air cylinder 85 of the roller moving mechanism also is operated to move the developer feed roller 66 from the retracted position to the processing position. The developer feed roller 66 and other components now assume the position shown in FIG. 23.

In this state, the main roller body 75 of developer feed roller 66 shown in FIG. 9 is opposed to the marginal area (region indicated by arrow a in FIG. 5) between the forward end of plate 7 and the forward end of image area 8, or, strictly speaking, the marginal area between the pawls 34 of plate gripper 24 and the forward end of image area 8. In this state, as noted hereinbefore, the surface of main roller body 75 of developer feed roller 66 is spaced from the surface of plate 7 by the slight distance Y.

In this state, the roller rotating mechanism, under control of the control unit 140, rotates the developer feed roller 66 at high speed for a predetermined time. As a result, the developer accumulates in a sufficient quantity between the surface of the main roller body 75 of developer feed roller 66 and the surface of plate 7.

The time for rotating the developer feed roller 66 at high speed, preferably, is 2 to 3 seconds where, for example, the gap Y between the surface of main roller body 75 of developer feed roller 66 and the surface of plate 7 shown in FIG. 9 is approximately 0.3 mm, and 4 to 5 seconds where the gap Y is approximately 0.5 mm.

The rotating speed of developer feed roller 66 at this time, preferably, is 4 to 5 rps where, for example, the rotating speed of developer feed roller 66 in time of the developing process is 1 to 2 rps.

Next, the developer feed roller 66 is decelerated to a normal rotating speed. The motor 58 of printing driver 6 is operated to rotate the plate cylinder 11 at low speed clockwise from the position shown in FIG. 23. With the rotation of plate cylinder 11, the developer is applied over the surface of plate 7 mounted peripherally of plate cylinder 11, thereby developing the image area 8.

At this time, the main roller body 75 of developer feed roller 66 is not in direct contact with the image area 8 of plate 7. Consequently, the image area 8 is free from the rubbing action of developer feed roller 66 which could result in a processing unevenness due to vibration of developer feed roller 66. It is also possible effectively to avoid an imperfect deposition of silver which could occur when silver deposits formed immediately after the developer is fed are rubbed by the developer feed roller 66.

The image area 8 of plate 7 where the developer has been applied by the developer feed roller 66 then comes into contact with the squeeze roller 71. The developer applied to the surface of plate 7 is squeezed off by the squeeze roller 71 rotated through contact with the plate 7. At this time, the squeeze roller 71 may be cleaned by the brush roller 72. In parallel with this process, the fixer starts being jetted from the shower nozzle 69 to the fixer feed roller 68 in the fixing unit 62.

Figure 24:
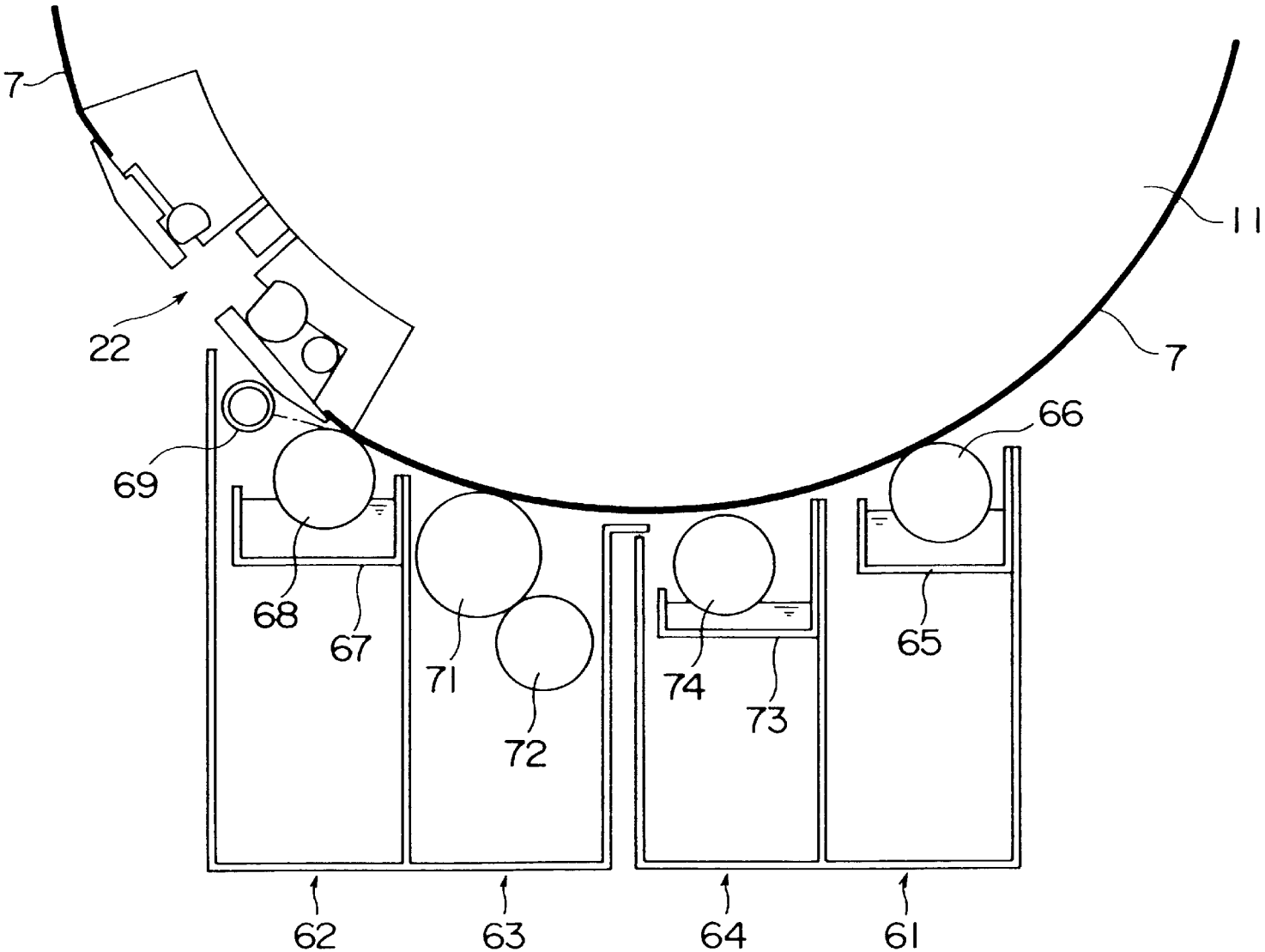
FIG. 24 is another explanatory view showing the developing operation.

With a further rotation of plate cylinder 11, the forward end of plate 7 mounted peripherally of plate cylinder 11 reaches a position opposed to the fixer feed roller 68 as shown in FIG. 24. In this state, as noted hereinbefore, the surface of main roller body 75 of fixer feed roller 68 is spaced from the surface of plate 7 by the slight distance Y. However, a sufficient accumulation of the fixer has been formed between the surface of main roller body 75 of fixer feed roller 68 and the surface of plate 7 as a result of the fixer being jetted thereto from the shower nozzle 69.

With a continued rotation of plate cylinder 11, the fixer is applied over the surface of plate 7 mounted peripherally of plate cylinder 11, thereby fixing the image area 8.

At this time, the main roller body 75 of fixer feed roller 68 is not in direct contact with the image area 8 of plate 7. Consequently, the image area 8 is free from the rubbing action of fixer feed roller 68, thereby effectively avoiding a processing unevenness due to vibration of fixer feed roller 68.

The developing and fixing operation for the first plate 7 is completed with the fixation of the image area 8 on this plate 7. The other plate 7 mounted peripherally of plate cylinder 11 is processed by repeating the same operation.

In this embodiment, the fixer is not removed from the plate surface by the squeeze roller 71 since the fixer remaining on the plate surface will not affect printing. However, the fixer may be removed by the squeeze roller 71 after the fixing process.

Figure 25:
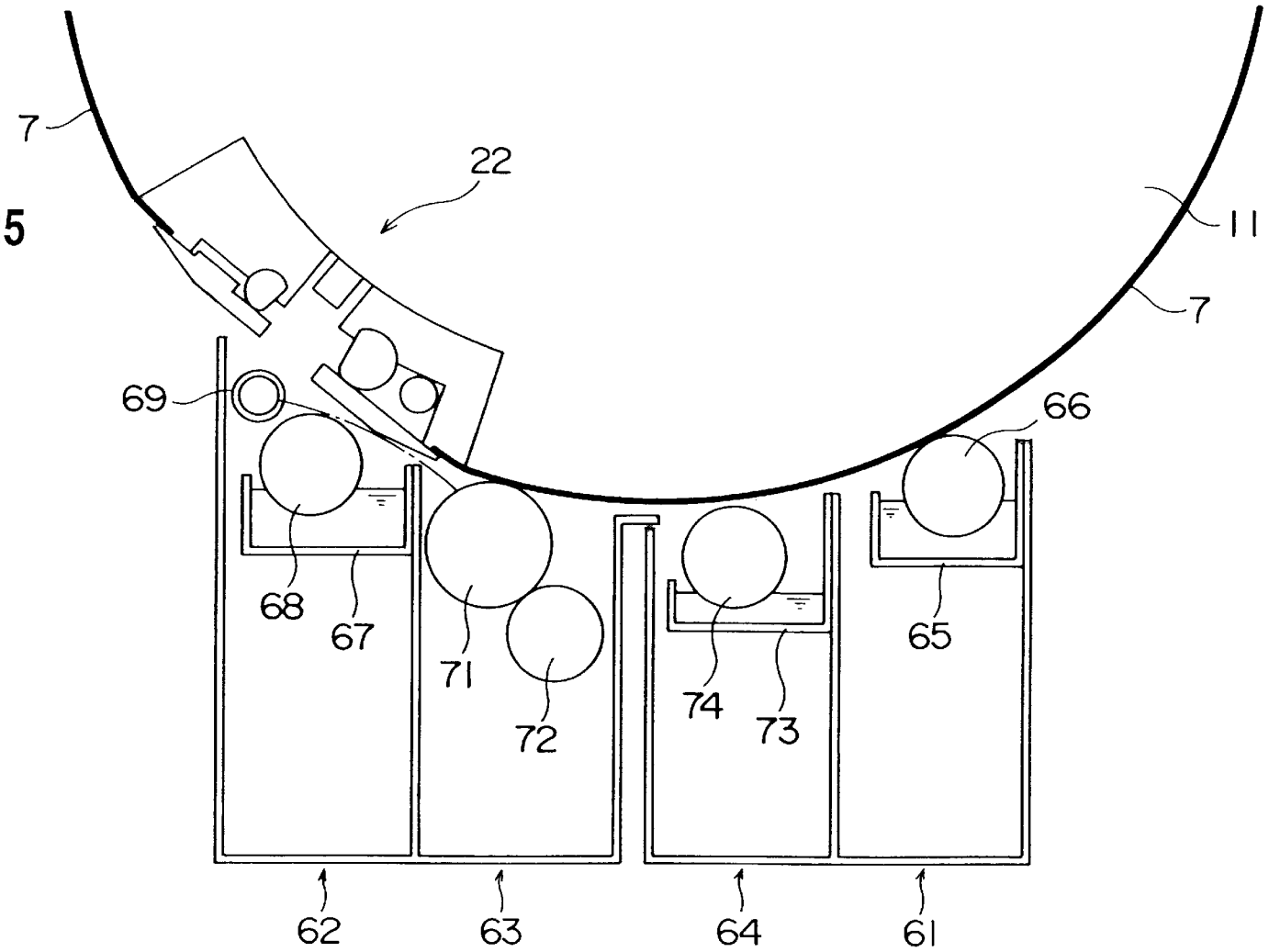
FIG. 25 is a further explanatory view showing the developing operation.

As shown in FIG. 25, when the cylinder groove 21 housing the plate grip mechanism 22 is opposed to the shower nozzle 69 in the fixing unit 62, with the fixer feed roller 68 moved to the retracted position, the fixer may be jetted from the shower nozzle 69 directly to the squeeze roller 71 to clean the squeeze roller 71 with the fixer.

Further, the fixer may be dripped to the fixer feed roller 68 instead of being jetted from the shower nozzle 69 to a location between the surface of plate 7 and the surface of main roller body 75 of fixer feed roller 68.

In the foregoing embodiments, the positioning elements 77 mounted coaxially on opposite end portions of developer feed roller 66 and fixer feed roller 68 are employed as the positioning mechanism for positioning the surfaces of developer feed roller 66 and fixer feed roller 68 at the slight distance from the surface of plate 7. It is possible to employ a positioning mechanism, for example, in the form of stoppers or the like for limiting the swing angle of the arms 82 and 92 of the roller moving mechanisms shown in FIGS. 12 and 13. This alternative construction can also position the surfaces of developer feed roller 66 and fixer feed roller 68 at the slight distance from the surface of plate 7.

The present invention may be embodied in other specific forms without departing from the spirit or essential attributes thereof and, accordingly, reference should be made to the appended claims, rather than to the foregoing specification, as indicating the scope of the invention.

The present application claims priority benefit under 35 U.S.C. Section 119 of Japanese Patent Application No. 11-24235 filed in the Japanese Patent Office on Feb. 1, 1999 and No. 11-255724 filed in the Japanese Patent Office on Sep. 9, 1999, the entire disclosure of which is incorporated herein by reference.

What is claimed is:

1. A printing apparatus comprising:

a plate cylinder for supporting a plate mounted peripherally thereof;

an image recorder for recording an image on said plate mounted peripherally of said plate cylinder;

a processing device for feeding a processing solution to and processing an image area of said plate where said image is recorded, said processing device including a processing solution feed roller slightly spaced from said image area to feed the processing solution to said image area in a substantially non-contact mode, and a drive mechanism for rotating said processing solution feed roller;

an ink feed mechanism for feeding ink to said plate; and a transfer mechanism for transferring the ink from said plate to printing paper.

2. A printing apparatus as defined in claim 1, wherein said processing device further includes a processing solution tank for storing the processing solution, said processing solution feed roller having at least a portion thereof immersed in said processing solution stored in said processing solution tank.

3. A printing apparatus as defined in claim 2, wherein said processing solution feed roller includes positioning members having a larger outside diameter than said processing solution feed roller, and mounted coaxially on opposite end portions of said processing solution feed roller, said positioning members positioning said processing solution feed roller to be slightly spaced from said image area to feed the processing solution to said image area in the substantially non-contact mode.

4. A printing apparatus as defined in claim 3, wherein said drive mechanism is operable to rotate said processing solution feed roller synchronously with said plate cylinder by transmitting rotation of said plate cylinder to said processing solution feed roller through said positioning members.

5. A printing apparatus as defined in claim 2, wherein said drive mechanism is operable to rotate said processing solution feed roller independently of said plate cylinder.

6. A printing apparatus as defined in claim 5, wherein said drive mechanism is operable to rotate said processing solution feed roller independently of said plate cylinder and in a position opposed to a region between a forward end of said plate and a forward end of said image area to form an accumulation of said processing solution between said plate and said processing solution feed roller.

7. A printing apparatus as defined in claim 2, wherein said processing device further includes a processing solution discharge mechanism for discharging said processing solution to a surface of said processing solution feed roller.

8. A printing apparatus comprising:

a plate cylinder for supporting a plate mounted peripherally thereof;

an image recorder for recording an image on said plate mounted peripherally of said plate cylinder;

a processing device for feeding a processing solution to and processing an image area of said plate where said image is recorded, said processing device including a processing solution feed roller for feeding said processing solution to said image area, and a roller moving mechanism for moving said processing solution feed roller between a processing position adjacent said plate mounted peripherally of said plate cylinder and a retracted position away from said plate;

a moving mechanism for moving said processing device in a substantially horizontal direction perpendicular to an axis of said plate cylinder;

an ink feed mechanism for feeding ink to said plate;

an impression cylinder rotatable with printing paper mounted peripherally thereof;

a blanket cylinder for transferring the ink from said plate to said printing paper mounted peripherally of said impression cylinder;

a printing paper feed mechanism for feeding said printing paper to said impression cylinder; and a printing paper discharge mechanism for discharging said printing paper having been printed from said impression cylinder.

9. A printing apparatus as defined in claim 8, wherein said processing device further includes a developer feed roller for feeding a developer to said image area, and a fixer feed roller for feeding a fixer to said image area, said developer feed roller and said fixer feed roller being movable by individual roller moving mechanisms between said processing position and said retracted position.

10. A printing apparatus as defined in claim 9, wherein said processing device is disposed below said plate cylinder, said apparatus further comprising a lift mechanism for lowering said processing device, said moving mechanism moving said processing device in the substantially horizontal direction after said lift mechanism lowers said processing device.

* * * * *